US007223530B2

(12) United States Patent
Hendricks, III et al.

(10) Patent No.: US 7,223,530 B2
(45) Date of Patent: May 29, 2007

(54) PHOTOGRAPHIC IMAGING ELEMENT WITH REDUCED FRINGING

(75) Inventors: Jess B. Hendricks, III, Rochester, NY (US); Patti L. Mellars, Webster, NY (US); Jayme D. Ribeiro, Pittsford, NY (US); Ronald A. Gogle, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 81 days.

(21) Appl. No.: 11/230,343

(22) Filed: Sep. 20, 2005

(65) Prior Publication Data

US 2006/0063116 A1 Mar. 23, 2006

Related U.S. Application Data

(60) Provisional application No. 60/611,265, filed on Sep. 20, 2004.

(51) Int. Cl.

| | |
|---|---|
| ***G03C 1/46*** | (2006.01) |
| ***G03C 7/00*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/504; 430/502; 430/503; 430/505; 430/506; 430/552; 430/553; 430/558; 430/362; 430/357; 430/374

(58) Field of Classification Search ..... 430/502–506, 430/543, 567, 552, 553, 558, 357, 362, 374
See application file for complete search history.

(56) References Cited

U.S. PATENT DOCUMENTS

| | | | |
|---|---|---|---|
| 5,736,303 | A | 4/1998 | McSweeney et al. |
| 5,744,287 | A | 4/1998 | Roberts et al. |
| 6,268,116 | B1 | 7/2001 | Roberts et al. |
| 6,280,916 | B1 | 8/2001 | Roberts |
| 6,312,880 | B1 | 11/2001 | Roberts et al. |

FOREIGN PATENT DOCUMENTS

| | | | |
|---|---|---|---|
| JP | 05/142712 | A | 6/1993 |

*Primary Examiner*—Geraldine Letscher
(74) *Attorney, Agent, or Firm*—Lynne M. Blank

(57) ABSTRACT

The invention relates to a photographic element comprising a support and at least three color records comprising at least three light sensitive layers and at least two interlayers, wherein the light sensitive layers include cyan, magenta, or yellow dye-forming coupler, the light sensitive layers include silver halide grains comprising greater than 90% silver chloride, scavengers are included in the interlayers, the ratio of the total level of scavenger to the total level of coupler is from 0.15 to 0.50, the ratio of the total level of scavenger to the total level of silver is from 0.05 to 0.15, and the reciprocity characteristics of the silver halide grains are such that for a separation exposure of 1 microsecond and 0.4 seconds, upon development, the difference in maximum density is 10% or less and a method for processing the element comprising color developing the element for less than 30 seconds.

21 Claims, No Drawings

PHOTOGRAPHIC IMAGING ELEMENT WITH REDUCED FRINGING

CROSS-REFERENCE TO RELATED APPLICATION

This is a 111A application of Provisional Application Ser. No. 60/611,265 filed on Nov. 20, 2004.

FIELD OF THE INVENTION

The present invention relates to an image-forming method using a silver halide color photographic light-sensitive material, and in particular to a method for obtaining a high-quality image at a low cost.

BACKGROUND OF THE INVENTION

In a silver halide photographic element, a color image is formed when the element is exposed to light and then subjected to color development with an aromatic amine developer. Color development results in imagewise reduction of silver halide and production of oxidized developer. Oxidized developer then reacts with one or more incorporated dye-forming couplers to form an imagewise distribution of dye.

Color photographic materials and methods commonly employ silver halide emulsions, with silver chloride emulsions being particularly suitable in many applications. In photofinishing processes, which use photosensitive paper to produce color prints, it is generally desirable to shorten the processing time to improve productivity. One way to shorten the processing time is to accelerate the development rate by using primarily silver chloride emulsions.

The continuing thrust towards digital printing of photographic color papers has created the need for a consumer color paper that can work in both optical and digital exposure equipment. Ideally, a color paper that could substantially maintain tone scale from conventional optical negative working exposure times to sub microsecond digital direct writing exposure times would be preferred. This would enable a photofinishing area to maintain one paper for both digital and optical exposure thereby reducing the need for expensive inventory.

There is also a continuing need to reduce costs associated with the manufacturing of color print media, as well as a need to improve the ease of manufacture. One way to reduce cost is to reduce the level of silver per unit area of media. Another way is to reduce the level of expensive chemicals, such as color-forming coupler compounds. However, when these approaches are attempted, often the resulting photographic prints obtained have poor color, and the resulting color reproduction is unacceptable. Another problem often observed when silver and coupler levels are reduced is a problem termed fringing. Fringing can occur when the print medium is given a digital exposure (high intensity for a short period of time). It is a color aberration with respect to text and lines in the image; the text and lines appear to have a "fringe" of color. The fringing problem also limits the amount that silver that can be reduced to adjust the curve shape of the photographic media during manufacturing process, making the media more difficult to manufacture.

Typical photographic color print media include a multilayer structure having three light sensitive silver halide image recording layers, as well as other non-light sensitive interlayers. The image recording layers typically comprise silver halide and a dye-forming coupler. Commonly, the print media includes three color records, which correspond to three layers in which the silver halide is sensitive to red, green, and blue light respectively and contain cyan, magenta, and yellow dye-forming couplers respectively. During photographic processing the silver halide reacts with developer to form oxidized developer (Dox) that undergoes further reaction with coupler to produce image dye, preferably in the same image-recording layer in which the Dox is formed. Because Dox can migrate to other layers in the structure, it is possible for it to react with the wrong coupler and form unwanted dye. The term "chemical cross talk" refers to the formation of unwanted dye caused by migration of oxidized developer from one image recording layer to another.

One aspect of interimage, that is, the effect of one layer on another, in photographic paper relates to the propensity of chemical cross talk occurring during development. Papers with high interimage show degraded color reproduction and have a more restricted color gamut (range of accessible colors) relative to a paper having low interimage that produces the same image dyes. To control cross talk, image recording layers are surrounded by non-light sensitive interlayers that contain reactive chemicals known in the trade as "scavengers". Scavengers are organic compounds that convert oxidized developer back to developer, or a noncolored by-product, before the oxidized developer can migrate to an adjacent color record and form unwanted dye. Scavengers are typically organic reducing agents, including but not limited to, compounds known in the trade as hydroquinones and their derivatives. For example, see R. W. G. Hunt, The Reproduction of Color in Photography, Printing and Television, 4th Edition, Copyright 1987, Fountain Press, Chapter 8, Plate 10, which describes the structure of conventional color paper and shows the interlayers separating the three dye-forming image layers and U.S. Pat. No. 5,744,287 teaches preferred dye characteristic curves for a conventional paper in a sub-50 microsecond exposure.

Lower contrast toe regions of the paper H&D, also known in the art as D-log E or D-log H, curves can alleviate contouring. Kokai JP 05/142712-A of Kawai teaches the preferred toe shape of the characteristic dye curve in a scanning exposure employing 10-bit modulation.

A limitation of organic reducing agents as interlayer scavengers is their reactivity with image dye after photographic processing. Because scavengers are retained in the coating after processing, conditions that promote diffusion of the scavenger into a dye-containing layer may lead to dye destruction due to reaction of the scavenger with the dye to form colorless by-products. Common surface treatments, such as embossing, promote the migration of scavengers into image layers by subjecting prints to localized high pressure (~5000 psi). Treatment of the surface with organic solvents can have the same effect.

Another limitation relates to the migration of scavenger into the dye-forming layers prior to photographic processing. In this case, the scavenger may compete for Dox with dye-forming coupler and cause less efficient dye formation, resulting in loss of desired density and/or contrast. In particular, dispersions of magenta dye-forming couplers derived from pyrazoletriazoles are susceptible to scavenger competition. Neutral flat fields that develop to a more green looking neutral at the slit edge of a coating illustrate this problem. The cutting knives may subject the coating to enough local stress to force the scavenger into the magenta dye-forming layer, causing this layer to develop to a lower density on the edge of the coating.

Scavengers also interfere with the light stability of the image dyes either by direct reaction with the dye when exposed to light, or by reaction with other components such as UV dyes and chemical stabilizers that are coated with photographic couplers to protect the image dyes from exposure to light. Destruction of the UV dyes or stabilizers enhances the rate of fade of the image dye.

Scavengers also limit the inherent chemical efficiency of a photographic system because Dox is lost to reactions that produce no image dye. Raising the level of silver to compensate for the loss of Dox can lead to increased chemical cross talk and process sensitivity. More efficient conversion of Dox to image dye permits lower silver lay downs and shorter development times for a given density.

These problems have been described in detail in U.S. Pat. No. 5,736,303, which teaches the preferred ratio of gel to organic component in the coating layers to minimize scavenger migration. It would be more preferred, however, to reduce the level of scavengers in the interlayers while retaining suitable color quality for both optical and digital exposures.

U.S. Pat. Nos. 6,312,880; 6,280,916; and 6,268,116, incorporated herein by reference in their entirety, describe a multilayer photographic element including light sensitive layers and non-light sensitive dye-forming interlayers wherein each interlayer is completely or substantially scavenger free. This approach may alleviate many of the problems associated with high scavenger levels, however, scavenger compounds are relative low molecular weight, simple molecules while coupler compounds tend to be high molecular weight, complex and expensive chemicals. Although this approach has the advantage of essentially eliminating the scavenger, it has the undesirable effect of replacing the relatively inexpensive scavenger chemicals with expensive couplers. Thus, this is not a practical approach that would provide economical photographic materials.

PROBLEM TO BE SOLVED

There remains a need to improve photographic media while reducing material cost.

SUMMARY OF THE INVENTION

The present invention relates to a multilayer photographic element comprising a reflective support and at least three color records comprising at least three light sensitive layers and at least two interlayers, wherein the at least three light sensitive layers include at least one cyan, magenta, or yellow dye-forming coupler, the at least three light sensitive layers include silver halide grains comprising greater than 90% silver chloride, one or more scavengers are included in the at least two interlayers, the ratio of the total level of scavenger to the total level of coupler in the multilayer photographic element is from 0.15 to 0.50, the ratio of the total level of scavenger to the total level of silver in the multilayer photographic element is from 0.05 to 0.15, and the reciprocity characteristics of the silver halide grains of at least two of the at least three color records are such that for a separation exposure of 1 microsecond and 0.4 seconds, upon development, the difference in maximum density is 10% or less. The present invention also includes a method for processing an exposed multilayer photographic element comprising color developing the exposed multilayer photographic element, wherein the color developing is for less than 30 seconds, and wherein the multilayer photographic element comprises a reflective support and at least three color records comprising at least three light sensitive layers and at least two interlayers, wherein the at least three light sensitive layers include at least one cyan, magenta, or yellow dye-forming coupler, the at least three light sensitive layers include silver halide grains comprising greater than 90% silver chloride, one or more scavengers are included in the at least two interlayers, the ratio of the total level of scavenger to the total level of coupler in the multilayer photographic element is from 0.15 to 0.50, the ratio of the total level of scavenger to the total level of silver in the multilayer photographic element is from 0.05 to 0.15, and the reciprocity characteristics of the silver halide grains of at least two color records of the at least three color records are such that for a separation exposure of 1 microsecond and 0.4 seconds, upon development, the difference in maximum density is 10% or less.

ADVANTAGEOUS EFFECT OF THE INVENTION

The present invention includes several advantages, not all of which are incorporated in a single embodiment. The imaging elements according to the present invention are lower in cost, due to raw material reductions, and have decreased levels of fringing. The imaging elements provide print material with efficient use of exposed silver. The print material can be processed more rapidly.

DETAILED DESCRIPTION OF THE INVENTION

The present invention relates to a multilayer photographic element including a reflective support, at least three color records with at least three light sensitive layers and at least two interlayers. At least three light sensitive layers include at least one cyan, magenta, or yellow dye-forming coupler. At least three light sensitive layers include silver halide grains comprising greater than 90% silver chloride. One or more scavengers are included in at least two interlayers and the ratio of the total level of scavenger to the total level of coupler in the photographic element is from 0.15 to 0.50. The ratio of the total level of scavenger to the total level of silver in the photographic element is from 0.05 to 0.15. The reciprocity characteristics of the silver halide grains of at least two color records are such that for a separation exposure of 1 microsecond and 0.4 seconds, upon development, the difference in maximum density (Dmax) is 10% or less.

In an attempt to make an inexpensive color paper, changing the scavenger/coupler and scavenger/silver ratios by reducing the scavenger in the paper gave a surprising photographic response. This photographic response was reduced fringing. As described previously, fringing is a color aberration with respect to text and edges in the image. Previous attempts at reducing cost by reducing silver and coupler laydown gave poor color responses, which included increased fringing. By using the optimum scavenger/coupler and scavenger/silver ratios, an unexpected favorable response with respect to fringing was achieved. This was particularly noted in systems having decreased silver laydown, which would normally increase the propensity for fringing. This is useful, novel and unexpected.

Fringing may be best understood by example. In the case of white text on a black background, fringing may produce white text that assumes some color. In the case of white text on a black background, fringing may also result in white text in which the white area is diminished. White text may also be both diminished in area and colored at the same time.

Fringing may occur anytime you have a sharp density difference, for example, the line of demarcation between the white text and black background.

It is common practice to utilize scavengers in the interlayer that perform the function of reacting with Dox before it can develop coupler in another layer and thereby contaminate the color reproduction of the element. One such scavenger, for examples is DOH (2,5-bis(1,1,3,3-tetramethylbutyl)-1,4-benzenediol). DOH that is not consumed during processing has the disadvantage that it can yellow the photographic element upon aging. DOH that reacts with Dox, has the effect of wasting Dox, since the Dox is not utilized to develop color. The instant invention is able to get maximum performance from developed silver.

For purposes of the present invention, "scavengers" are organic compounds that convert oxidized developer back to developer, or a noncolored by-product before the oxidized developer can migrate to an adjacent color record and form unwanted dye. Scavengers are typically organic reducing agents, including but not limited to, compounds known in the trade as hydroquinones and their derivatives. In one desirable embodiment of the present invention, the scavenger is DOH. Desirably, at least one scavenger is present in one or more interlayers. Suitably, the interlayers are substantially silver halide free and preferably have no silver halide.

A full color photographic imaging element has at least one layer comprising a cyan dye-forming coupler, one layer comprising a magenta dye-forming coupler, and one layer comprising a yellow dye-forming coupler and produces, when developed, an image in full color. Imaging layers are layers that contain sensitized silver halide and dye-forming coupler.

As one might expect, there is a complex relationship between the level of scavenger, coupler, and silver in a photographic element. By adjusting the ratio of the total level (mmol/$m^2$) of scavenger to the total level (mmol/$m^2$) of coupler in the photographic element to 0.50 or less and the ratio of the total level of scavenger to the total level (mmol/$m^2$) of silver to 0.15 or less, a reduction in the cost of materials can be achieved while providing a more robust element that is less susceptible to the problem of fringing. This then allows a reduction in the level of silver, which would normally not be possible because of the fringing problem. It also allows the level of silver to be changed during the manufacturing process in order to adjust the curve shape without incurring the fringing problem. If these ratios are lowered too much, there can be a loss in color purity. It is desirable that the ratio of scavenger to coupler be 0.15 or greater and the ratio of scavenger to silver be 0.05 or greater, in order to maintain acceptable print quality for most applications.

In another suitable embodiment, the ratio of the total level of scavenger to the total level of coupler in the photographic element is from 0.15 to 0.50 or in the range 0.15 to 0.45 or 0.20 to 0.40. In a further desirable embodiment, the ratio is in the range of from 0.25 to 0.30. The ratio of the total level of scavenger to the total level of silver in the photographic is desirably from 0.05 to 0.15. In one embodiment, this ratio is from 0.05 to 0.12, or suitably from 0.08 to 0.12. In another embodiment, the total amount of silver present in the photographic element is from 3.0 to 4.0 mmol/$m^2$.

In one aspect of the invention the total amount of scavenger present is in the range of 0.20 to 0.50 mmol/$m^2$ of the photographic element. In another suitable aspect the total level of scavenger present is in the range of 0.30 to 0.40 mmol/$m^2$. The optimum amount of the scavenger in each of the interlayers of the photographic element, as well as the levels of the couplers and silver in each light-sensitive layer can be determined by doing designed experiments. For examples of experimental design see D. C. Montgomery, *Design And Analysis Of Experiments,* 5th ed., John Wiley, New York, (2001), incorporated herein by reference.

In order to maintain acceptable print quality, it is desirable to use dye-forming couplers that will give high good color rendition. In one embodiment, the cyan dye-forming coupler useful in the invention is represented by the Formula CC-1.

CC-1

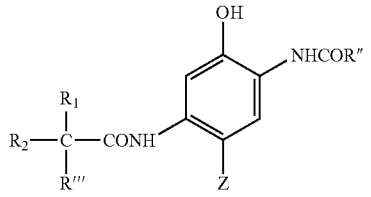

In Formula CC-1, R" and R‴ are independently selected from unsubstituted or substituted alkyl, aryl, amino, alkoxy and heterocyclyl groups. Z represents hydrogen, chloro, fluoro, substituted aryloxy or mercaptotetrazole group. $R_1$ and $R_2$ independently represent hydrogen or an unsubstituted or substituted alkyl group.

In one suitable embodiment, Z represents hydrogen or a chloro substituent, $R_1$ represents hydrogen, $R_2$ represents an alkyl group, R" represents a substituted phenyl group, R‴ represents a ballast group that contains 10 to 30 carbon atoms.

In another embodiment, at least one light sensitive layer includes a pyrrolotriazole cyan dye-forming coupler. Examples of useful pyrrolotriazole couplers include those described in U.S. Pat. Nos. 6,773,875; 6,649,771; 6,495,697; and 5,437,967, incorporated herein by reference. Suitably, the pyrrolotriazole coupler may be represented by Formula CC-2.

(CC-2)

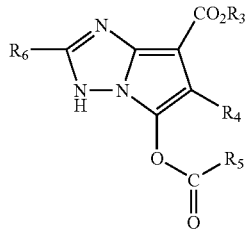

In Formula (CC-2), $R_3$ represents an unsubstituted or substituted alkyl, aryl, amino, alkoxy or heterocyclyl group. For example, $R_3$ can represent an unsubstituted or substituted cyclohexyl ring group or a t-butyl group. $R_4$ represents an electron-withdrawing group, such as a cyano substituent or a carbamoyl group. $R_5$ represents an unsubstituted or substituted alkyl, aryl, amino, alkoxy or heterocyclyl group. Desirably $R_5$ represents a N,N'-dialkylamino group. $R_6$ represents an unsubstituted or substituted alkyl, aryl, or heterocyclyl group. Suitably, $R_6$ represents an unsubstituted or susbstituted phenyl group.

Desirably, one light sensitive layer includes a pyrazoletriazole magenta dye-forming couple. Suitably, the pyrazo letriazole magenta dye-forming coupler may be represented by of Formula MC-1,

MC-1

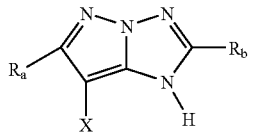

In Formula MC-1, $R_a$ and $R_b$ independently represent H or a substituent group; and X represents hydrogen or a chloro group.

In a further embodiment, at least one light sensitive layer comprises a yellow dye-forming coupler of Formula YC-1,

YC-1

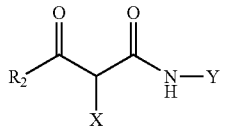

In Formula YC-1, $R_2$ represents a substituent group, X represents a coupling-off group, and Y represents an aryl group.

Surprisingly, by using the inventive ratios of scavenger, coupler, and silver, it is possible to shorten the processing time of the element while maintaining or improving the resulting color reproduction. These ratios improve the developability of the element and it is possible to shorten the color development step to less than 30 seconds, or even less than 20 seconds, or suitably to less than 15 seconds. It is also possible to shorten the corresponding bleach/fix and wash times. In one aspect of the invention, the total processing time, corresponding to the time required for the development step, the bleach/fix step, and the stabilizer step, is less than 95 seconds. Desirably, the total processing time is less than 85 seconds, or even less than 70 seconds, and suitably less than 50 seconds. The reduced processing time can result in improved productivity.

It is most desired that the photographic element of the invention be suitable for both optical and digital exposures. It is highly desirable that the reciprocity characteristics of the silver halide grains of at least two color records are such that for a separation exposure of 1 microsecond and 0.4 seconds, upon development, the difference in maximum density is about 10% or less. In one suitable embodiment, the silver halide grains of three color records meet his requirement.

In a separation exposure, by the use of filters, only one color record of the photographic element is exposed. For example, the element can be given an exposure of red light, which would expose the red light-sensitive layer, which includes the cyan dye-forming coupler. After development, only cyan dye would be formed.

The reciprocity characteristics of a color record can be determined, for example, in the following manner. A sample of the photographic element, such as a coating on a paper support, can be given a separation exposure for a time of 0.4 seconds. The exposure can be carried out while contacting the sample with a neutral stepped exposure tablet having an exposure range of 0 to 3 log-E. After development, Status A reflection densities of the sample can be determined to generate a density vs. log exposure (D vs. Log-E) relationship for this color record. From this relationship one can determine the maximum density (Dmax) obtained for a 0.4 second exposure. This process can be repeated in the same fashion for an identical sample, except the sample is given a 1 micosecond exposure, and the Dmax resulting from this exposure can be determined. The difference in Dmax for the 0.4 second and the 1 microsecond exposures can then be determined.

It is desirable that the reciprocity characteristics of at least two color records, for example, such as the red and blue color records, are such that for a separation exposure of 1 microsecond and 0.4 seconds, upon development, the difference in maximum density of each color record is 10% or less. In one embodiment the reciprocity characteristics of at least two color records are such that for a separation exposure of 1 microsecond and 0.4 seconds, upon development, the difference in maximum density is 7% or less or even about 5% or less for each color record. In another embodiment the reciprocity characteristics of the silver halide grains of the three color records are such that for a separation exposure of 1 microsecond and 0.4 seconds, upon development, the difference in maximum density is 5% or less. In a further embodiment, the reciprocity characteristics of three color records, the red, green and blue color records, are such that for a separation exposure of 1 microsecond and 0.4 seconds, upon development, the difference in maximum density for each record is about 10% or less. Illustrative desirable reciprocity characteristics are shown in Table A. It is a feature of this invention that prints made either by optical or by digital exposure have substantially the same excellent characteristics.

TABLE A

Illustrative Reciprocity Characteristics.

| Color Record | 0.4 Second Exposure Dmax | 1 Microsecond Exposure Dmax | Difference | Percent Difference |
|---|---|---|---|---|
| Red | 2.198 | 2.096 | 0.102 | 4.6% |
| Green | 2.084 | 1.876 | 0.208 | 10.0% |
| Blue | 2.023 | 1.914 | 0.109 | 5.4% |

In another aspect of the invention, from the D vs. Log-E relationship described above, one can determine the density at a log range of 1.0 relative to an exposure point producing a density 0.04 above Dmin. This corresponds to approximately the shoulder of the D vs. Log E curve. The difference in Dmax for the 0.4 second and the 1 microsecond separation exposures at this point should be less than 10% for each color record. Desirably this difference is 5% or less for each color record The terms as used herein, "top", "upper", "emulsion side", "imaging side" and "face" mean the side or towards the side of an imaging member bearing the imaging layers or developed image. The terms "bottom", "lower side", and "back" mean the side or towards the side of the imaging member opposite from the side bearing the imaging layers or developed image. The term substrate as used herein refers to a support or base material that is the primary part of an imaging element such as paper, polyester, vinyl, synthetic paper, fabric, or other suitable material for the viewing of images. As used herein, the phrase "photographic element" is a material that utilizes photosensitive silver halide in the formation of images.

The photographic elements are full color elements. Full color elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

The photographic emulsions useful for this invention are generally prepared by precipitating silver halide crystals in a colloidal matrix by methods conventional in the art. The colloid is typically a hydrophilic film-forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

The reflective support of the present invention preferably includes a resin layer with a stabilizing amount of hindered amine extruded on the top side of the imaging layer substrate. Hindered amine light stabilizers (HALS) originate from 2,2,6,6-tertramethylpiperidine. The hindered amine should be added to the polymer layer at about 0.01–5% by weight of said resin layer in order to provide resistance to polymer degradation upon exposure to UV light. The preferred amount is at about 0.05–3% by weight. This provides excellent polymer stability and resistance to cracking and yellowing while keeping the expense of the hindered amine to a minimum. Examples of suitable hindered amines with molecular weights of less than 2300 are Bis(2,2,6,6-letramethyl-4-piperidinyl)sebacate; Bis(1,2,2,6,6-pentamethyl-4-piperidinyl)sebacate; Bis(1,2,2,6,6-pentamethyl-4-piperidinyl)2-n-butyl-(3,5-di-tert-butyl-hydroxybenzyl)malonate; 8-Acetly-3-dodecyl-7,7,9,9-tetramethly-1,3,8-triazaspirol (4,5)decane-2,4-dione; Tetra(2,2,6,6-tetramethyl-4-piperidinyl)1,2,3,4-butanetetracarboxylate; 1-(-2-[3,5-di-tert-butyl-4-hydroxyphenyl-propionyloxyl]ethyl)4-(3,5-di-tert-butyl-4-hydroxyphenylpropionyloxy)-2,2,6,6-tetramethylpiperidine; 1,1'-(1,2-ethenadiyl)bis(3,3,5,5-tetramethyl-2-piperazinone). The preferred hindered amine is 1,3,5-triazine-2,4,6-triamine,N,N'''-[1,2-ethanediylbis[[[4,6-bis(butyl(1,2,2,6,6-pentamethyl-4-piperidinyl) amino]-1,3,5-triazine-2-yl]imino]-3,1 propanediyl]]-bis[N',N''-dibutyl-N',N''-bis(1,2,2,6,6-pentamethyl-4-piperidinyl). Mixtures of polymers and hindered amines may be extruded onto imaging paper. The polymer to paper adhesion is excellent and the long term stability of the imaging system against cracking and yellowing is improved.

Suitable polymers for the resin layer include polyethylene, polypropylene, polymethylpentene, polystyrene, polybutylene, and mixtures thereof. Polyolefin copolymers, including copolymers of polyethylene, propylene and ethylene such as hexene, butene, and octene are also useful. Polyethylene is most preferred, as it is low in cost and has desirable coating properties. As polyethylene, usable are high-density polyethylene, low-density polyethylene, linear low density polyethylene, and polyethylene blends. Other suitable polymers include polyesters produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Other polymers are matrix polyesters having repeat units from terephthalic acid or naphthalene dicarboxylic acid and at least one glycol selected from ethylene glycol, 1,4-butanediol and 1,4-cyclohexanedimethanol such as poly(ethylene terephthalate), which may be modified by small amounts of other monomers. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510, incorporated herein by reference. Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

Any suitable white pigment may be incorporated in the polyolefin layer, such as, for example, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The preferred pigment is titanium dioxide because of its high refractive index, which gives excellent optical properties at a reasonable cost. The pigment is used in any form that is conveniently dispersed within the polyolefin. The preferred pigment is anatase titanium dioxide. The most preferred pigment is rutile titanium dioxide because it has the highest refractive index at the lowest cost. The average pigment diameter of the rutile $TiO_2$ is most preferably in the range of 0.1 to 0.26 μm. The pigments that are greater than 0.26 μm are too yellow for an imaging element application and the pigments that are less than 0.1 μm are not sufficiently opaque when dispersed in polymers. Preferably, the white pigment should be employed from from about 10 to about 50 percent by weight, based on the total weight of the polyolefin coating. Below 10 percent $TiO_2$, the imaging system will not be sufficiently opaque and will have inferior optical properties. Above 50 percent $TiO_2$, the polymer blend is not manufacturable. The surface of the $TiO_2$ can be treated with an inorganic compounds such as aluminum hydroxide, alumina with a fluoride compound or fluoride ions, silica with a fluoride compound or fluoride ion, silicon hydroxide, silicon dioxide, boron oxide, boria-modified silica (as described in U.S. Pat. No. 4,781,761, incorporated herein by reference), phosphates, zinc oxide, $ZrO_2$, etc. and with organic treatments such as polyhydric alcohol, polyhydric amine, metal soap, alkyl titanate, polysiloxanes, silanes, etc. The organic and inorganic $TiO_2$ treatments can be used alone or in any combination. The amount of the surface treating agents is preferably from 0.2 to 2.0% for the inorganic treatment and 0.1 to 1% for the organic treatment, relative to the weight of the weight of the titanium dioxide. At these levels of treatment the $TiO_2$ disperses well in the polymer and does not interfere with the manufacture of the imaging support.

The polymer, hindered amine light stabilizer, and the $TiO_2$ are mixed with each other in the presence of a dispersing agent. Examples of dispersing agents are metal salts of higher fatty acids such as sodium palmitate, sodium stearate, calcium palmitate, sodium laurate, calcium stearate, aluminum stearate, magnesium stearate, zirconium octylate, zinc stearate, etc, higher fatty acids, higher fatty amide, and higher fatty acids. The preferred dispersing agent is sodium stearate and the most preferred dispersing agent is zinc stearate. Both of these dispersing agents give superior whiteness to the resin-coated layer.

For photographic use, tints can be added to the waterproof resin coated layer to yield tinted support or non-tinted support can be used and the tint can be added to the emulsion containing or non-emulsion containing layers. With either method of tint addition, an overall slightly bluish tint is preferred. In tinting the support, the layers of the waterproof resin coating preferably contain colorants such as bluing agent and magenta or red pigment. Applicable bluing agents include commonly know ultramarine blue, cobalt blue, oxide cobalt phosphate, quinacridone pigments, and mixtures thereof. Applicable red or magenta colorants are quinacridones and ultramarines. When these same tints are added to the sensitized layers or non-emulsion containing layers, a white base is used and the tints provide similar bluish overall color.

The resin may also include a fluorescing agent, which absorb energy in the UV region and emit light largely in the blue region. Any of the optical brighteners referred to in U.S. Pat. No. 3,260,715, incorporated herein by reference, or a combination thereof would be beneficial.

The resin may also contain an antioxidant(s) such as hindered phenol primary antioxidants used alone or in combination with secondary antioxidants. Examples of hindered phenol primary antioxidants include pentaerythrityl tetrakis[3-(3,5-di-tert-butyl-4-hydroxyphenyl)proprionate] (such as Irganox 1010), octadecyl 3-(3,5-di-tert-butyl-4-hydroxyphenyl)proprionate (such as Irganox 1076 which will be referred to as compound B), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD 1024), 2,2'-thiodiethylenebis[3-(3,5-di-tert-butyl-4-hydroxyphenyl)proprionate] (such as Irganox 1035), 1,3,5-trimethyl-2,4,6-tri(3,5-di-tert-butyl-4-hydroxybenzyl) benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), 2,4-bis(1,1-dimethylphenyl)phosphite (such as Irgafos 168).

The hindered amine light stabilizer, $TiO_2$, colorants, slip agents, optical brightener, and antioxidant are incorporated either together or separately with the polymer using a continuous or Banburry mixer. A concentrate of the additives in the form of a pellet is typically made. The concentration of the rutile pigment can be from 20% to 80% by weight of the master batch. The master batch is then adequately diluted for use with the resin.

The support to which the waterproof resin layer is laminated may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371, incorporated herein by reference. The preferred support is a photographic grade cellulose fiber paper.

The thickness of the resin layer which is applied to a base paper of the reflective support used in the present invention at a side for imaging, is preferably from 5 to 100 μm and most preferably from 10 to 50 μm. The thickness of the resin layer applied to a base paper on the side opposite the imaging element is preferably in a range from 5 to 100 μm and more preferably from 10 to 50 μm.

The surface of the waterproof resin coating at the imaging side may be a glossy, fine, silk, grain, or matte surface. On the surface of the waterproof coating on the backside which is not coated with an imaging element may also be glossy, fine, silk, or matte surface. The preferred waterproof surface for the backside away from the imaging element is matte.

While described above as utilizing a photographic base of paper having polyethylene layers applied thereto for waterproofing and as to serve as a base for the color forming layers, the invention also may utilize photographic laminated base that has biaxially oriented polyolefin sheets laminated to each side of a base. In a preferred form this base uses biaxially oriented polypropylene sheets on each side of a paper sheet with a polyethylene surface layer on one sheet which aids in binding of the gelatin layers to the base. Such a base is described at U.S. Pat. Nos. 5,866,282; 5,888,643; and 5,888,683, incorporated herein by reference. These materials have the advantage that they allow sharper images and a brighter, more glossy finish on a base that is tougher and more tear resistant.

In another embodiment, the support comprises a synthetic paper, preferably cellulose-free, having a foamed polymer core or a foamed polymer core that has adhered thereto at least one flange layer. The polymers described for use in a polymer core may also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure; the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. Preferably, the foamed polymer core comprises a polymer expanded through the use of a blowing agent.

In a preferred embodiment of this invention polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis (benzene sulfonyl hydrazide) (OBSH), N,N'-dinitrosopentamethyltetramine (DNPA), sodium borohydride, and other blowing agent agents well known in the art. The preferred chemical blowing agents would be sodium bicarbonate/citric acid mixtures, azodicarbonamide; though others may also be used. These foaming agents may be used together with an auxiliary foaming agent, nucleating agent, and a cross-linking agent.

The flange layers, which may be applied to the core of the support, may be chosen to satisfy specific requirements of flexural modulus, caliper, surface roughness, and optical properties such as colorimetry and opacity. The flange members may be formed integral with the core by manufacturing the core with a flange skin sheet or the flange may be laminated to the core material. The integral extrusion of flange members with the core is preferred for cost. The lamination technique allows a wider range of properties and materials to be used for the skin materials.

As used herein, the phrase "photographic element" is a material that utilizes photosensitive silver halide in the formation of images. The photographic elements may be black and white, single color elements or multicolor elements. Multicolor elements contain image dye-forming units sensitive to each of the three primary regions of the spectrum. Each unit may comprise a single emulsion layer or multiple emulsion layers sensitive to a given region of the spectrum. The layers of the element, including the layers of the image-forming units, may be arranged in various orders as known in the art. In an alternative format, the emulsions sensitive to each of the three primary regions of the spectrum may be disposed as a single segmented layer.

In one embodiment, the invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^4$ ergs/cm$^2$ for up to 10 milliseconds seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. In a preferred practical application, the advantages can be transformed into increased throughput of digital substantially artifact-free color print images while exposing each pixel sequentially in synchronism with the digital data from an image processor. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

For a display material used with this invention, at least one image layer containing silver halide and a dye-forming coupler located on the top side or surface and bottom side or surface of the imaging element is suitable. Applying the imaging layer to either the top and bottom is suitable for a photographic display material, but it is not sufficient to create a photographic display material that is optimum for both a reflection display and a transmission display. For the display material used with this invention, at least one image layer comprises at least one dye-forming coupler located on both the top and bottom of the imaging support used with this invention is preferred. Applying an imaging layer to both the top and bottom of the support allows for the display material to have the required density for both reflective viewing and for transmission viewing of the image. This duplitized "day/night" photographic display material has significant commercial value in that the day/night display material may be used for both reflective viewing and transmission viewing. Prior art display materials were optimized for either transmission viewing or reflective viewing but not both simultaneously.

It has been found that the duplitized emulsion coverage should be in a range that is greater than 75% and less than 175% of typical emulsion coverages for reflective consumer paper that contain typical amounts of silver and coupler. At coverages of less than 75% on the front side it was found that a pleasing reflection print may not be obtained. Further, at coverages of less than 75% on the backside, pleasing transmission images may not be obtained. Coverages greater than 175% are undesirable because of the increased material expense and also because of the need for extended development times in the processing solutions. In a more preferred embodiment, emulsion laydowns should be from 100 to 150% of that found for a typical reflective consumer color paper.

The display material used with this invention wherein the amount of dye-forming coupler is substantially the same on the top and bottom sides is most preferred because it allows for optimization of image density, while allowing for developer time less than 50 seconds. Further, coating substantially the same amount of light sensitive silver halide emulsion on both sides has the additional benefit of balancing the imaging element for image curl caused by the contraction and expansion of the hygroscopic gel typically found in photographic emulsions.

The photographic emulsions useful with this invention are generally prepared by precipitating silver halide crystals in a colloidal matrix by methods conventional in the art. The colloid is typically a hydrophilic sheet forming agent such as gelatin, e, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed with the invention may be those methods known in the art.

Chemical sensitization of the emulsion typically employs sensitizers such as: sulfur-containing compounds, for example, allyl isothiocyanate, sodium thiosulfate and allyl thiourea; reducing agents, for example, polyamines and stannous salts; noble metal compounds, for example, gold, platinum; and polymeric agents, for example, polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

The silver halide emulsions utilized with this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than 50 mole percent silver chloride. Preferably, they are greater than 90 mole percent silver chloride; and optimally greater than 95 mole percent silver chloride.

The silver halide emulsions may contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements useful with the invention may utilize emulsions as described in *The Theory of the Photographic Process*, Fourth Edition, T. H. James, Macmillan Publishing Company, Inc., 1977, pages 151–152, incorporated herein by reference. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization may be performed intentionally by adding reduction sensitizers, chemicals that reduce silver ions to form metallic silver atoms, or by providing a reducing environment such as high pH (excess hydroxide ion) and/or low pAg (excess silver ion). During precipitation of a silver halide emulsion, unintentional reduction sensitization may occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823, incorporated herein by reference. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, p. 113 (1979), incorporated herein by reference. Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino), incorporated herein by reference.

The photographic elements useful with this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND, incorporated herein by reference. Additionally, a general summary of the use of iridium in the sensitization of silver halide emulsions is contained in Carroll, "Iridium Sensitization: A Literature Review," Photographic Science and Engineering, Vol. 24, No. 6, 1980, incorporated herein by reference. A method of manufacturing a silver halide emulsion by chemically sensitizing the emulsion in the presence of an iridium salt and a photographic spectral sensitizing dye is described in U.S. Pat. No. 4,693,965, incorporated herein by reference. In some cases, when such dopants are incorporated, emulsions show an increased fresh fog and a lower contrast sensitometric curve when processed in the color reversal E-6 process as described in The British Journal of Photography Annual, 1982, pages 201–203, incorporated herein by reference.

A typical multicolor photographic element useful with the invention comprises a laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers. The support useful with the invention may also be utilized for black and white photographic print elements.

A radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3, or −4; M is a filled frontier orbital polyvalent metal ion, other than iridium; and $L_6$ represents bridging ligands which may be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand may be used with the present invention.

The combination of dopants (i) and (ii) provides greater reduction in reciprocity law failure than may be achieved with either dopant alone. The combination of dopants (i) and (ii) achieves reductions in reciprocity law failure beyond the simple additive sum achieved when employing either dopant class by itself. The combination of dopants (i) and (ii) provides greater reduction in reciprocity law failure, particularly for high intensity and short duration exposures. The combination of dopants (i) and (ii) further achieves high intensity reciprocity with iridium at relatively low levels, and both high and low intensity reciprocity improvements even while using conventional gelatino-peptizer (for example, other than low methionine gelatino-peptizer).

Improved reciprocity performance may be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, incorporated herein by reference, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. It is specifically contemplated to use significant levels (that is, greater than 1 weight percent of total peptizer) of conventional gelatin (for example, gelatin having at least 30 micromoles of methionine per gram) as a gelatino-peptizer for the silver halide grains of the emulsions useful with the invention. A gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

It may be contemplated to employ a class (i) hexacoordination complex dopant satisfying the formula:

$$[ML_6]^n \quad (I)$$

wherein n is zero, −1, −2, −3, or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands, which may be independently selected, provided that least four of the ligands are anionic ligands and at least one (preferably at least 3 and optimally at least 4) of the ligands is a cyano ligand or a ligand more electronegative than a cyano ligand. Any remaining ligands may be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736, all incorporated herein by reference. Useful neutral and anionic organic ligands for class (ii) dopant hexacoordination complexes are disclosed by Olm et al U.S. Pat. No. 5,360,712 and Kuromoto et al U.S. Pat. No. 5,462,849, incorporated herein by reference.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant may be distributed throughout the interior shell region delimited above or may be added as one or more bands within the interior shell region.

Class (i) dopant may be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)CN)_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986), all incorporated herein by reference. The class (ii) dopants are believed to create such deep electron traps. The thiazole ligands may be substituted with any photographically acceptable substituent which does not prevent incorporation of the dopant into the silver halide grain. Exemplary substituents include lower alkyl (for example, alkyl groups containing 1–4 carbon atoms), and specifically methyl. A specific example of a substituted thiazole ligand which may be used is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712; Olm et al U.S. Pat. No. 5,457,021; and Kuromoto et al U.S. Pat. No. 5,462,849, incorporated herein by reference.

In a preferred form it is contemplated to employ as a class (ii) dopant a hexacoordination complex satisfying the formula:

$$[IrL^1{}_6]^{n'} \quad (II)$$

wherein n' is zero, −1, −2, −3, or −4; and $L^1_6$ represents six bridging ligands which may be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant may be distributed throughout the interior shell region delimited above or may be added as one or more bands within the interior shell region.

Class (ii) dopant may be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(thiazole)]^{-2}$ (ii-2) $[IrCl_4(thiazole)_2]^{-1}$ (ii-3) $[IrBr_5(thiazole)]^{-2}$ (ii-4) $[IrBr_4(thiazole)_2]^{-1}$ (ii-5) $[IrCl_5(5\text{-methylthiazole})]^{-2}$ (ii-6) $[IrCl_4(5\text{-methylthiazole})_2]^{-1}$ (ii-7) $[IrBr_5(5\text{-methylthiazole})]^{-2}$ (ii-8) $[IrBr_4(5\text{-methylthiazole})_2]^{-1}$ A layer using a magenta dye-forming coupler, a class (ii) dopant in combination with an $OsCl_5(NO)$ dopant has been found to produce a preferred result.

Emulsions may be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide may be present in the grains up to its solubility limit, which is in silver iodochloride grains, under typical conditions of precipitation, 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, may be bromide. For color reflection print (that is, color paper) uses bromide is typically limited to less than 10 mole percent based on silver, and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within contemplation, to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0718679, incorporated herein by reference.

In another improved form the high chloride grains may take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 μm, preferably less than 0.2 μm, and optimally less than 0.07 μm. High chloride {160} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904, incorporated herein by reference.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice may take any convenient conventional form. These conventional features are illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

Some additional silver halide, typically less than 1 percent, based on total silver, may be introduced to facilitate chemical sensitization. It is also recognized that silver halide may be epitaxially deposited at selected sites on a host grain to increase its sensitivity. For example, high chloride {100} tabular grains with corner epitaxy are illustrated by Maskasky U.S. Pat. No. 5,275,930, incorporated herein by reference. For the purpose of providing a clear demarcation, the term "silver halide grain" is herein employed to include the silver used to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to select from among the low staining sensitizing dyes disclosed in U.S. Pat. Nos. 5,292,634; 5,316,904; 5,418,126 and 5,492,802, incorporated herein by reference. Use of low staining sensitizing dyes in a photographic element processed in a developer solution with little or no optical brightening agent (for instance, stilbene compounds such as Blankophor REU®) is specifically contemplated. Further, these low staining dyes can be used in combination with other dyes known to the art (Research Disclosure, September 1996, Item 38957, Section V, incorporated herein by reference).

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, the combination of similarly spectrally sensitized emulsions can be in one or more layers.

An important quality characteristic of a reproductive film system is color reproduction, which represents how accurately the hues of the original scene are reproduced. Many current color papers use a blue sensitizing dye that gives a maximum sensitivity at about 480 nm. Use of a sensitizing dye that affords a sensitivity maximum that is closer to that of the yellow image dye in film, for instance with a sensitivity maximum of around 450–470 nm, can result in a color paper with improved color reproduction.

Typical of image dye-forming couplers that may be included in the invention element are couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961), all incorporated herein by reference. Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948, incorporated herein by reference.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961), incorporated herein by reference. Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948, incorporated herein by reference.

Typical cyan couplers are represented by the following formulas:

CYAN-1

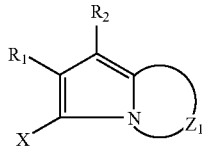

CYAN-2

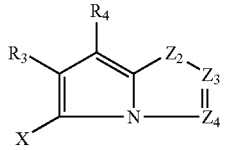

CYAN-3

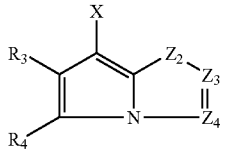

CYAN-4

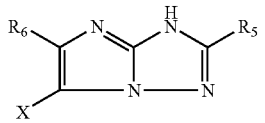

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

Even more preferable are cyan couplers of the following formulas:

CYAN-5

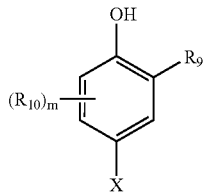

CYAN-6

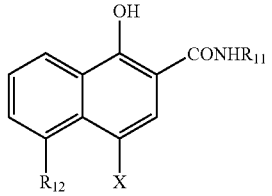

wherein $R_9$ represents a substituent (preferably a carbamoyl, ureido, or carbonamido group); $R_{10}$ represents a substituent (preferably individually selected from halogens, alkyl, and carbonamido groups); $R_{11}$ represents ballast substituent; $R_{12}$ represents a hydrogen or a substituent (preferably a carbonamido or sulphonamido group); X represents a hydrogen or a coupling-off group; and m is from 1–3.

A dissociative group has an acidic proton, for example, —NH—, —CH(R)—, that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants may be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill), incorporated herein by reference.

Another type of preferred cyan coupler is an "NB coupler" which is a dye-forming coupler which is capable of coupling with the developer 4-amino-3-methyl-N-ethyl-N-(2-methanesulfonamidoethyl)aniline sesquisulfate hydrate to form a dye for which the left bandwidth (LBW) of its absorption spectra upon "spin coating" of a 3% w/v solution of the dye in di-n-butyl sebacate solvent is at least 5 nm less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

A cyan dye-forming "NB coupler" which may be useful with the invention has the formula (IA)

(IA)

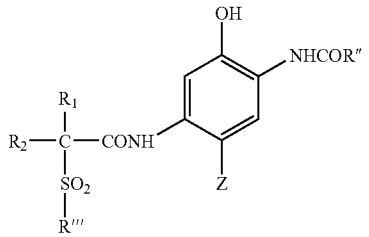

wherein

R' and R" are substituents selected such that the coupler is a "NB coupler", as herein defined; and Z is a hydrogen atom or a group which may be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

The "NB coupler" has the formula (I):

(I)

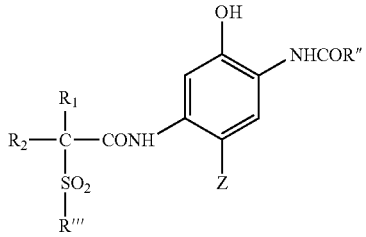

wherein

R" and R‴ are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R‴ is desirably an alkyl or aryl group or a 5- to 10-membered heterocyclic ring which contains one or more heteroatoms selected from nitrogen, oxygen and sulfur, which ring group is unsubstituted or substituted.

In the preferred embodiment the coupler of formula (I) may be a 2,5-diamido phenol in which the 5-amido moiety is an amide of a carboxylic acid which is substituted in the alpha position by a particular sulfone (—$SO_2$—) group such as, for example, described in U.S. Pat. No. 5,686,235, incorporated herein by reference. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally from 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and, in particular, 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom, and if only one of $R_1$ and $R_2$ is a hydrogen atom, then the other is preferably an alkyl group having 1 to 4 carbon atoms, more preferably 1 to 3 carbon atoms, and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I) when R'" is alkyl, it may be unsubstituted or substituted with a substituent such as halogen or alkoxy. When R'" is aryl or a heterocycle, it may be substituted. Desirably, it is not substituted in the position alpha to the sulfonyl group.

In formula (I), when R'" is a phenyl group, it may be substituted in the meta and/or para positions with 1 to 3 substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxy-carbonylamino and alkyl- or aryl-carbamoyl groups.

In particular, each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably, the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form for example polyalkylene oxides.

In formula (I) or (IA), Z is a hydrogen atom or a group which may be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, that is, whether it is a 2-equivalent or 4-equivalent coupler, and its particular identity may modify the reactivity of the coupler. Such groups may advantageously affect the layer in which the coupler is coated, or other layers in the photographic recording material by performing, after release from the coupler, functions such as dye formation, dye hue adjustment, development acceleration or inhibition, bleach acceleration or inhibition, electron transfer facilitation, color correction.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A, all incorporated herein by reference. Halogen, alkoxy, and aryloxy groups are most suitable.

Examples of specific coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

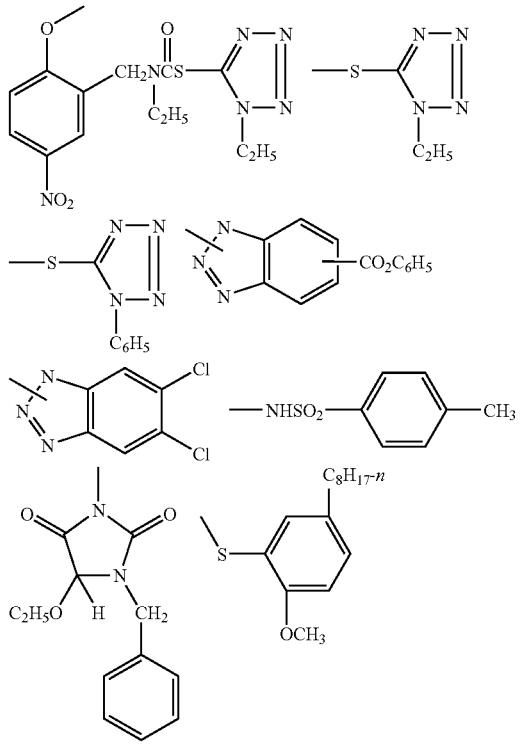

-continued

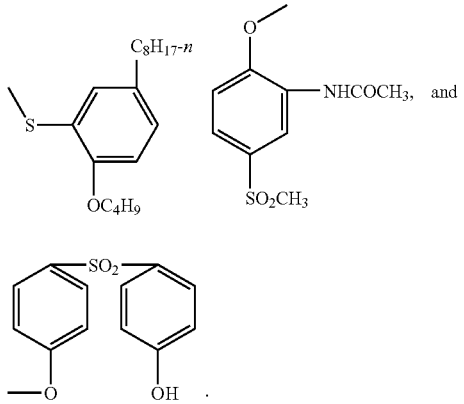

Typically, the coupling-off group is a chlorine atom, hydrogen atom, or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which, in combination, meet these criteria. In the preferred embodiments useful with the invention, $R_1$ in formula (I) is a small alkyl group or hydrogen. Therefore, in these embodiments the ballast would be primarily located as part of the other groups. Furthermore, even if the coupling-off group Z contains a ballast, it is often desirable to ballast the other substituents as well, since Z is eliminated from the molecule upon coupling; thus, the ballast is most advantageously provided as part of groups other than Z.

The following examples further illustrate preferred cyan couplers to be used with the invention. It is not to be construed that the present invention is limited to these examples.

IC-1

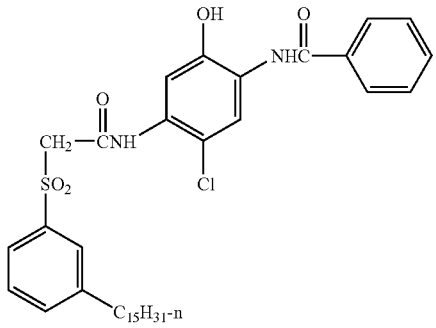

-continued

IC-2

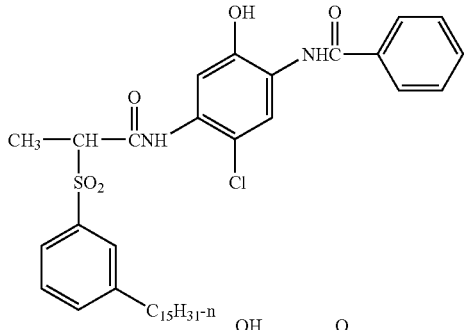

IC-3

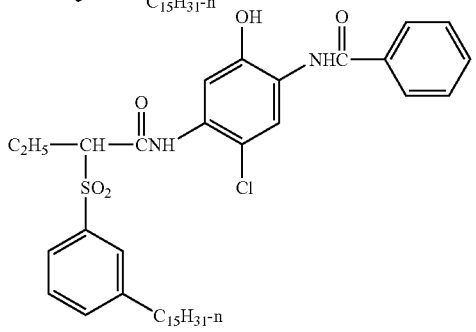

IC-4

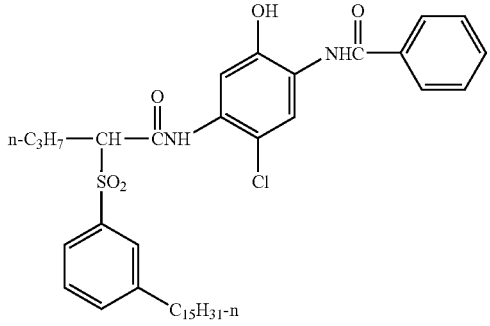

IC-5

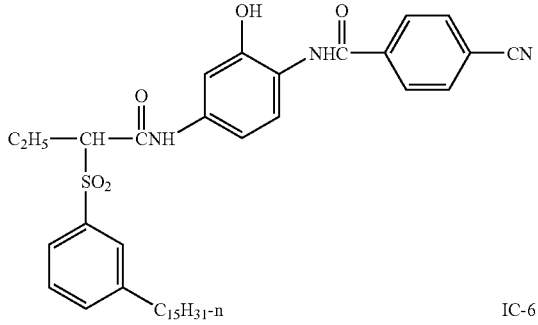

IC-6

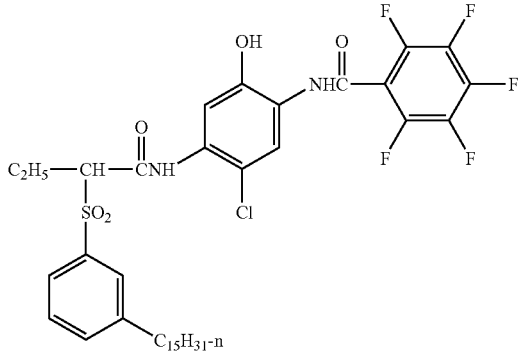

-continued
IC-7
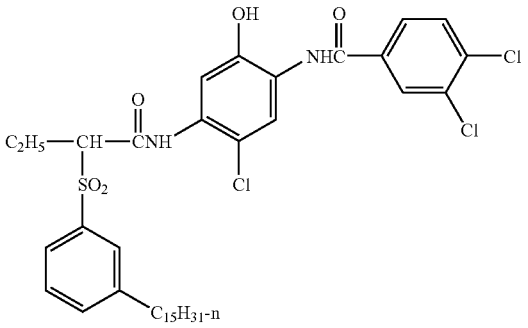
IC-8
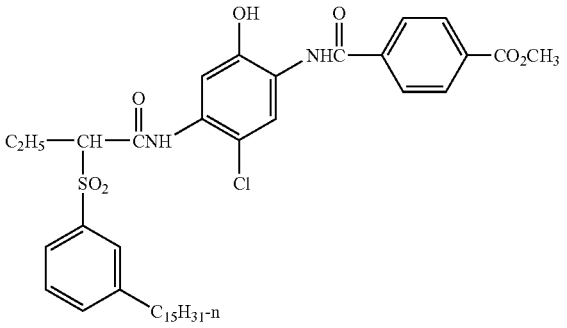
IC-9
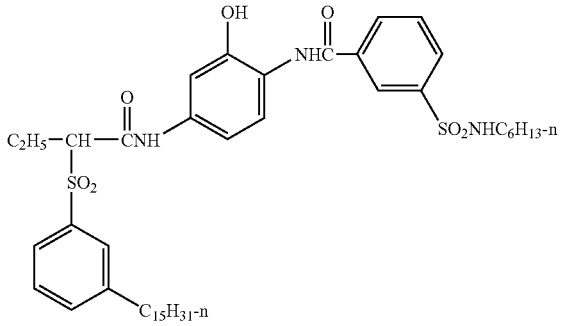
IC-10
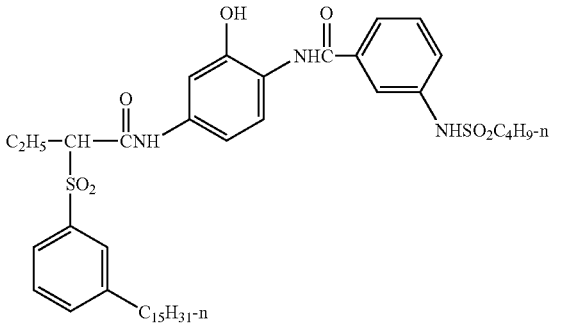
-continued
IC-11
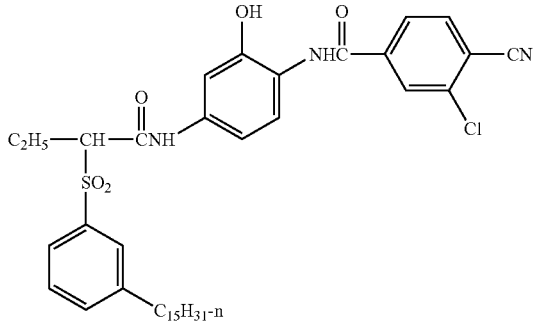
IC-12
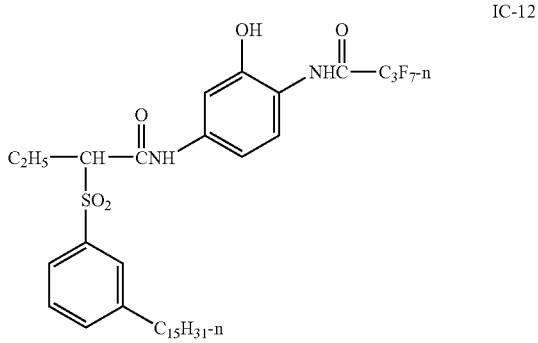
IC-13
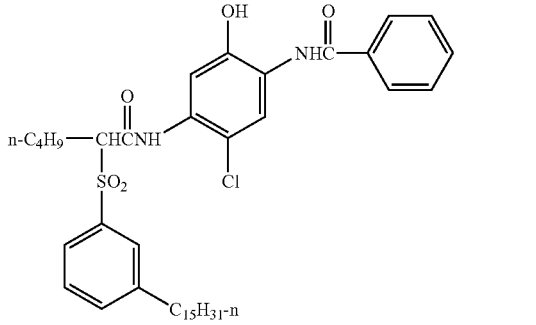
IC-14
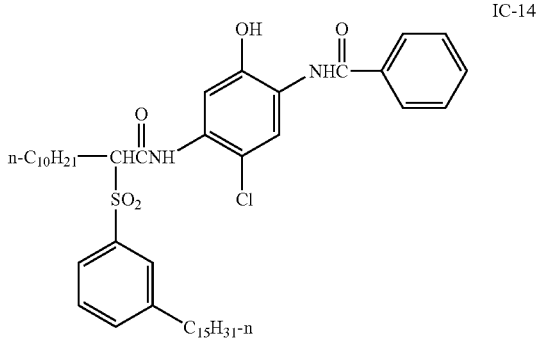

-continued
IC-15
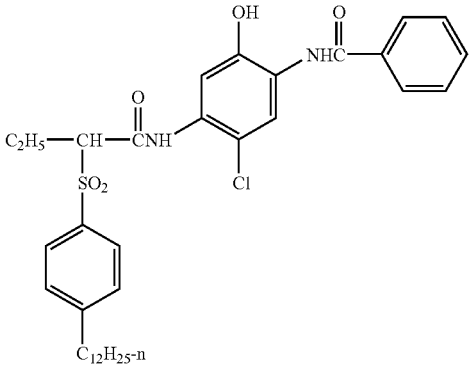
IC-16
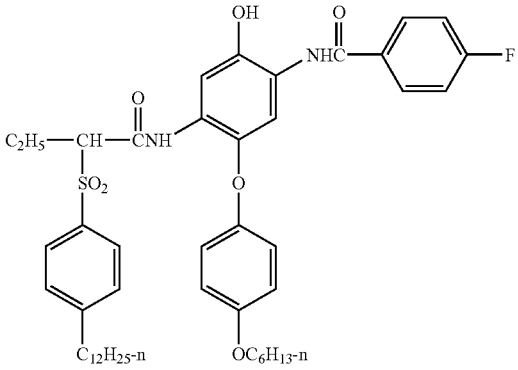
IC-17
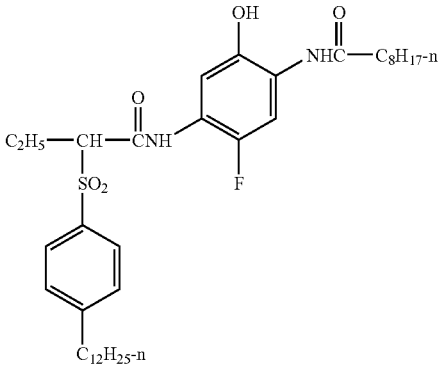
IC-18
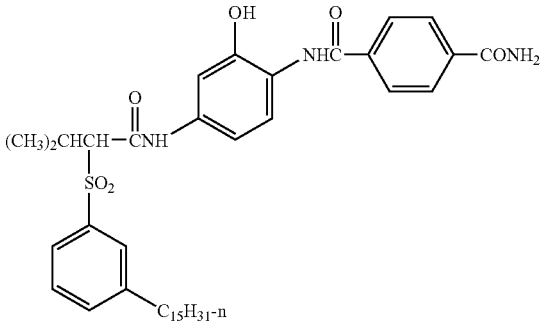
-continued
IC-19
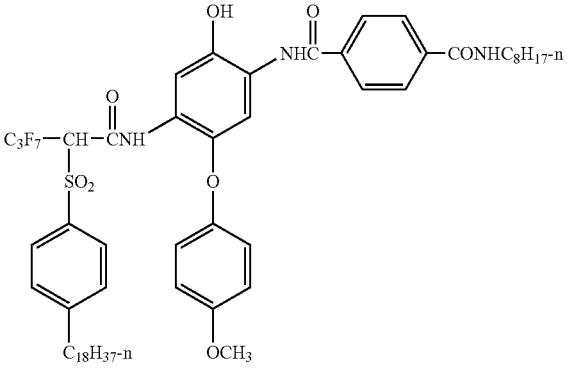
IC-20
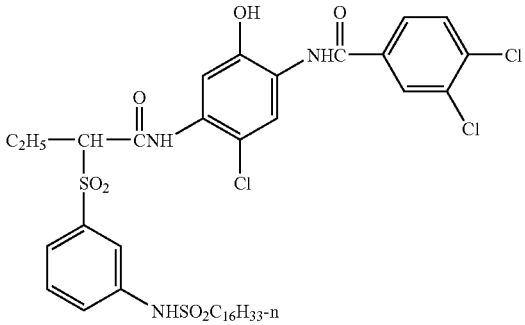
IC-21
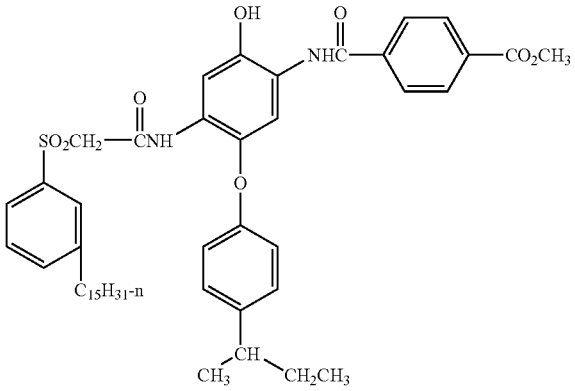
IC-22
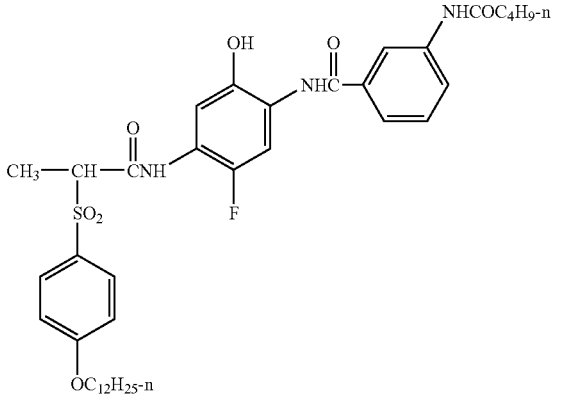

-continued
IC-23
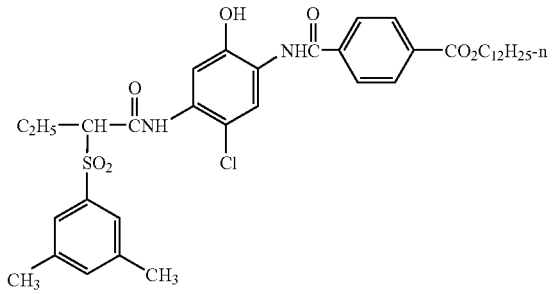
IC-24
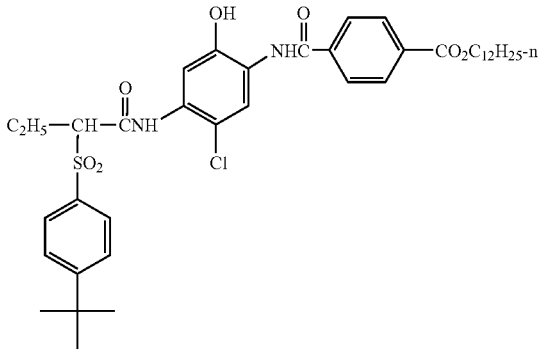
IC-25
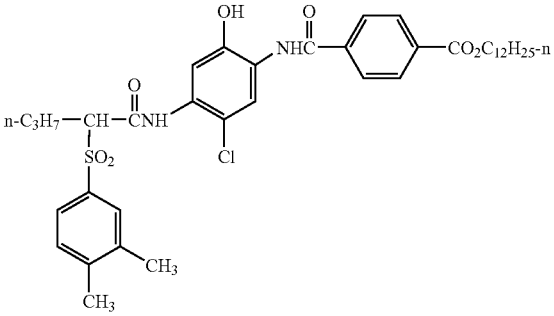
IC-26
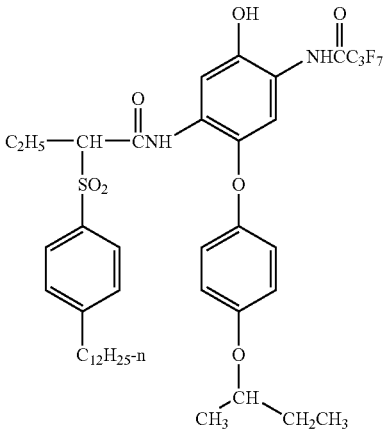
-continued
IC-27
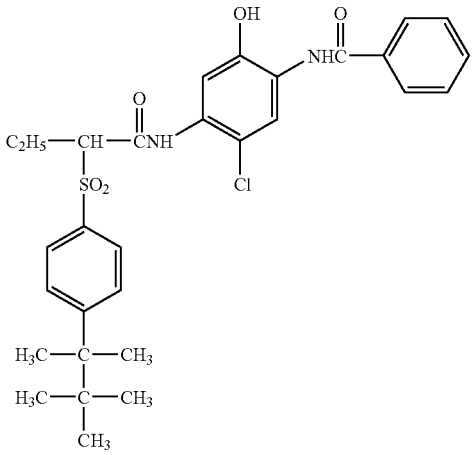
IC-28
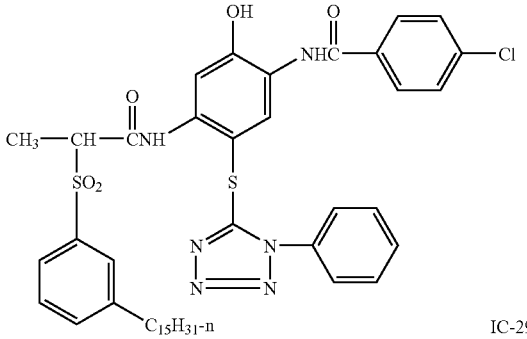
IC-29
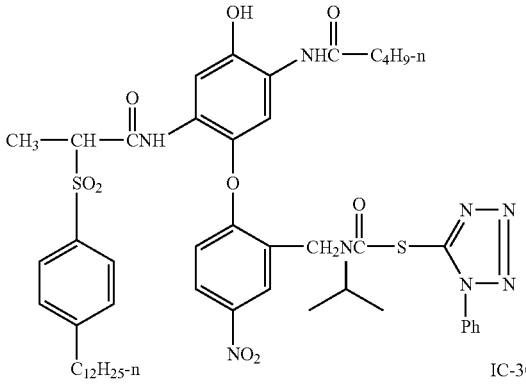
IC-30
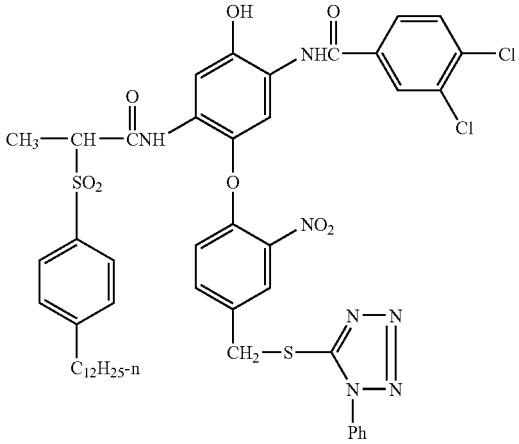

-continued
IC-31
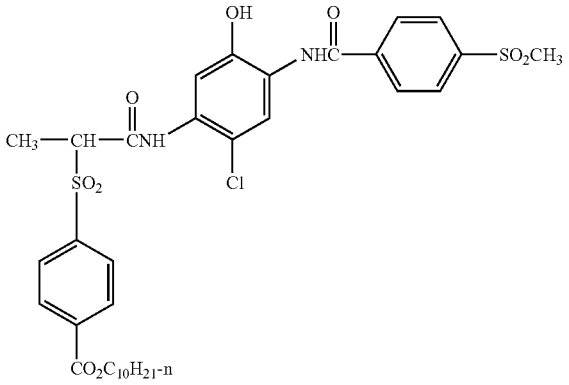
IC-32
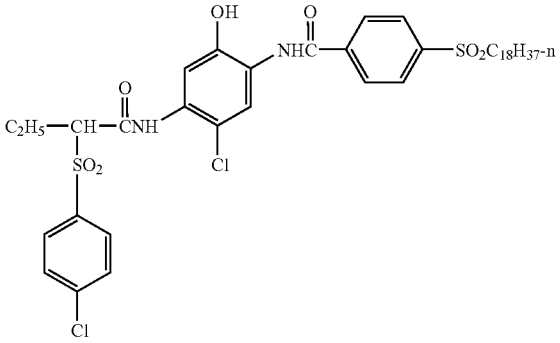
IC-33
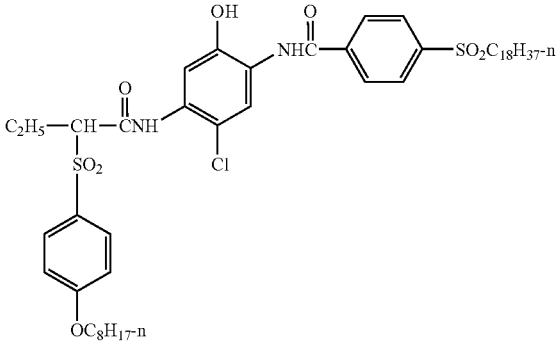
IC-34
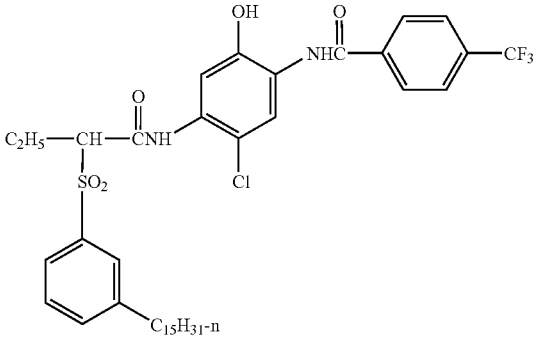
-continued
IC-35
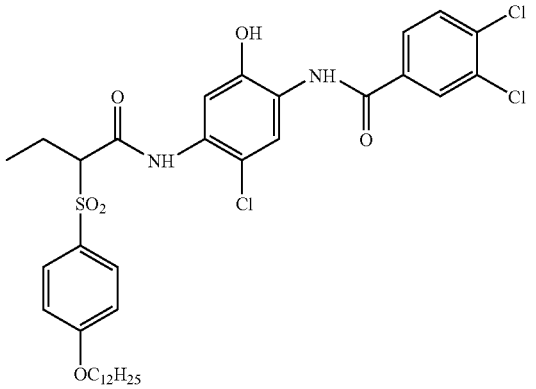
IC-36
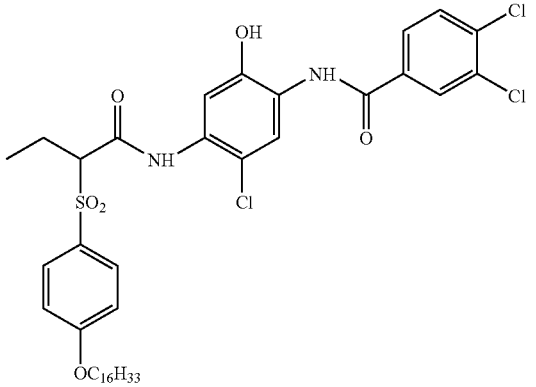
IC-37
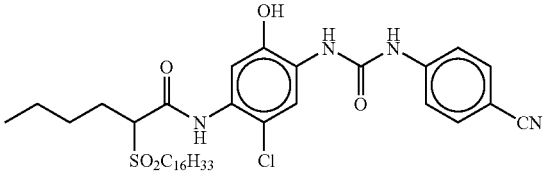
IC-38
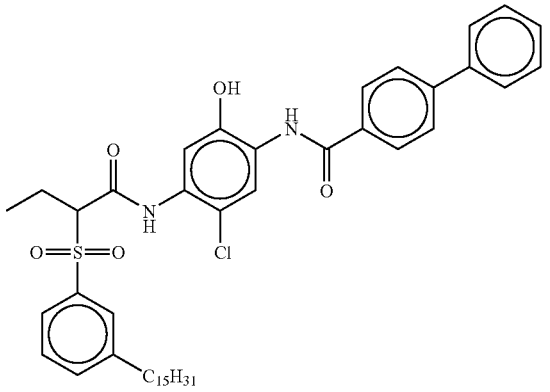

-continued

IC-39

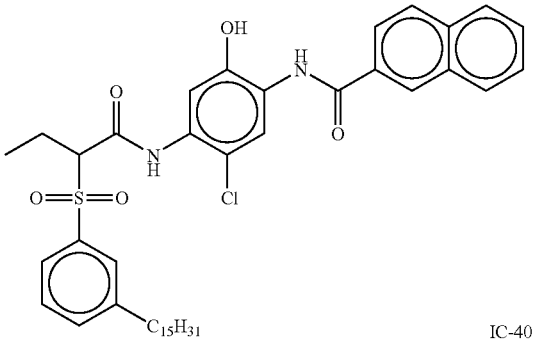

IC-40

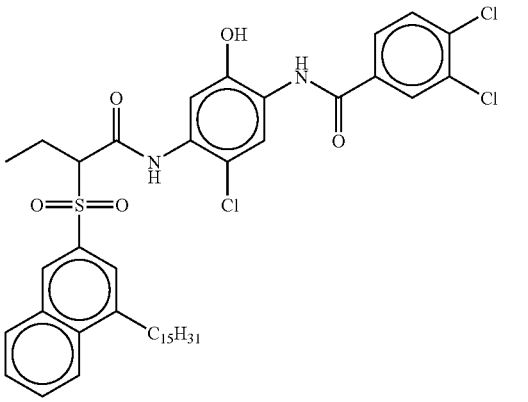

Preferred couplers are IC-3, IC-7, IC-35, and IC-36 because of their suitably narrow left bandwidths.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; and "Farbkupplereine Literature Ubersicht," published in Agfa Mitteilungen, Band III, pp. 126–156 (1961), incorporated herein by reference. Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles may be found in European Patent applications 176,804; 177,765; U.S. Pat. Nos. 4,659,652; 5,066,575; and 5,250,400, all incorporated herein by reference.

Typical pyrazoloazole and pyrazolone couplers are represented by the following formulas:

MAGENTA-1

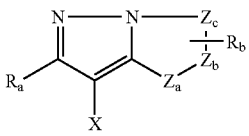

-continued

MAGENTA-2

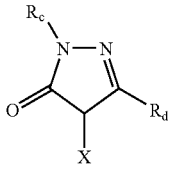

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, ═N—, ═C—, or —NH—, provided that one of either the $Z_a$-$Z_b$ bond or the $Z_b$-$Z_c$ bond is a double bond and the other is a single bond, and when the $Z_b$-$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

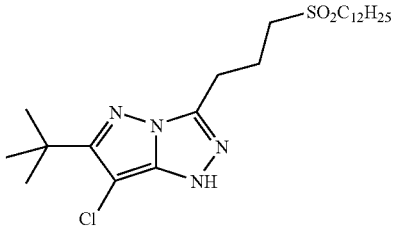

M-2

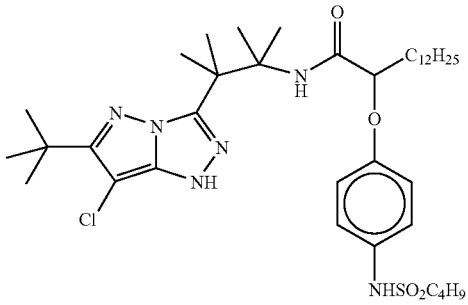

M-3

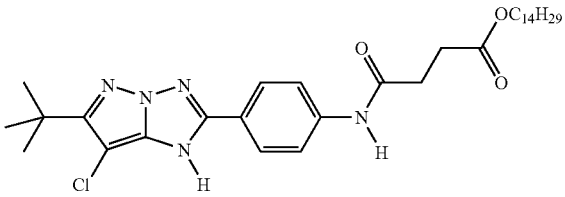

M-4

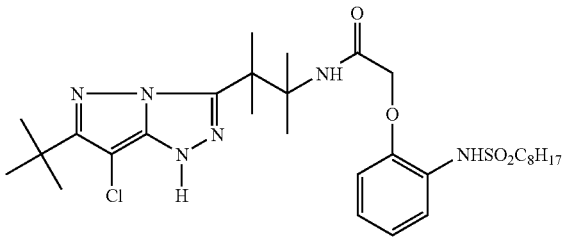

-continued

M-5

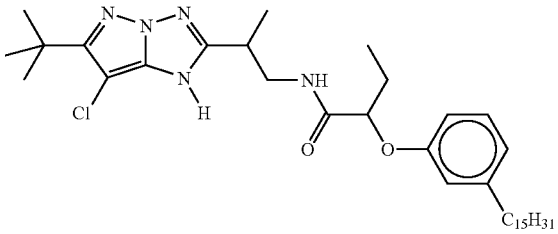

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961), incorporated herein by reference. Such couplers are typically open chain ketomethylene compounds. Also preferred are yellow couplers such as described in, for example, European Patent Application Nos. 482,552; 510,535; 524,540; 543,367; and U.S. Pat. No. 5,238,803, incorporated herein by reference. For improved color reproduction, couplers which give yellow dyes that cut off sharply on the long wavelength side are particularly preferred (for example, see U.S. Pat. No. 5,360,713, incorporated herein by reference).

Typical preferred yellow couplers are represented by the following formulas:

YELLOW-1

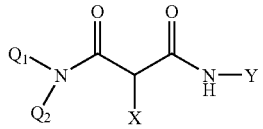

YELLOW-2

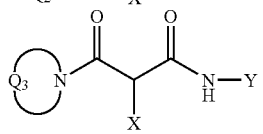

YELLOW-3

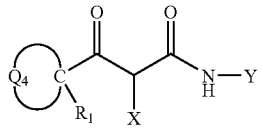

YELLOW-4

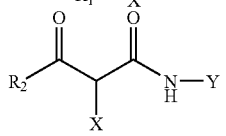

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group.

Preferred yellow couplers may be of the following general structures:

Y-1

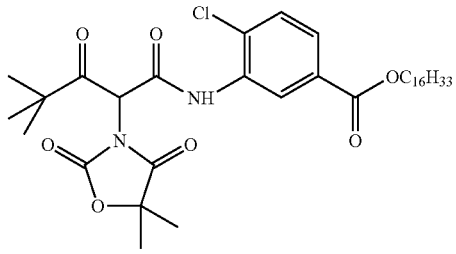

Y-2

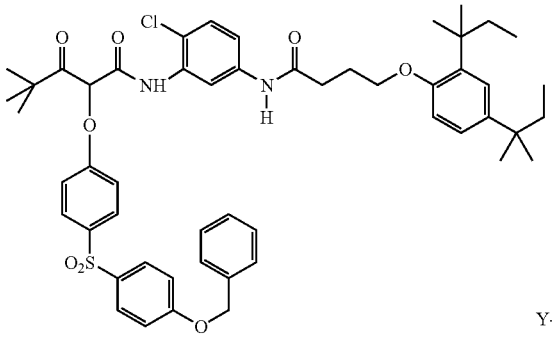

Y-3

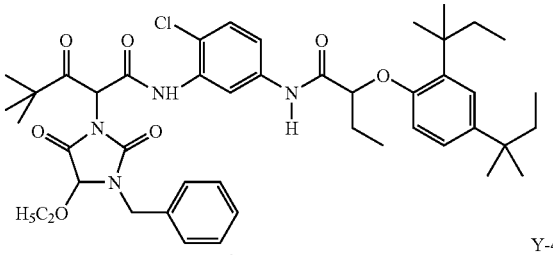

Y-4

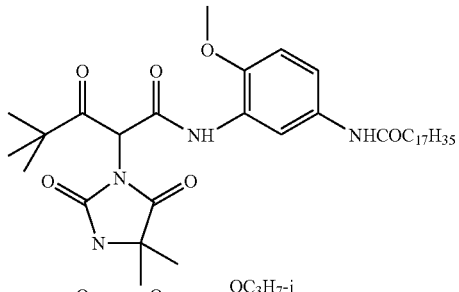

Y-5

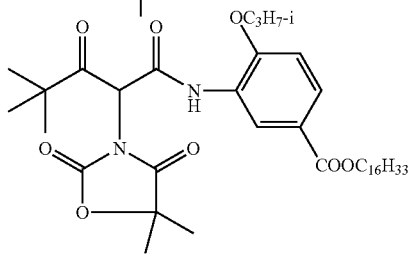

Y-6

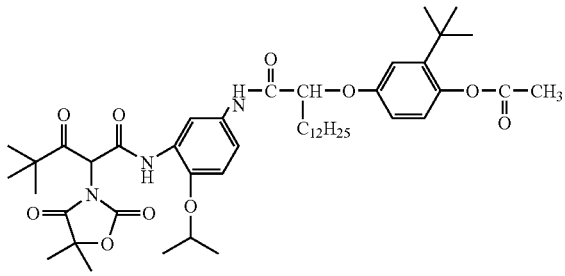

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonyl amino, p-dodecyl-phenylcarbonyl amino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy) butyl]sulfamoyl, N-methyl-N-tetradecylsulfamoyl, and N-dodecylsulfamoyl; carbamoyl, such as N-methylcarbamoyl, N,N-dibutylcarbarnoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and may include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents may also be further substituted.

Stabilizers and scavengers that may be used with the present invention, but are not limited to, the following:

ST-1

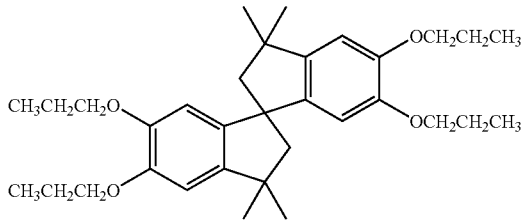

-continued
ST-2
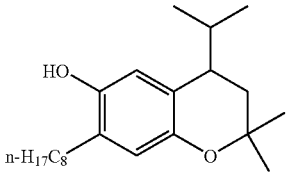
ST-3
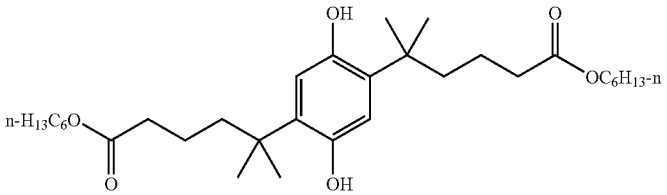
ST-4
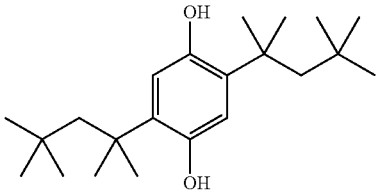
ST-5
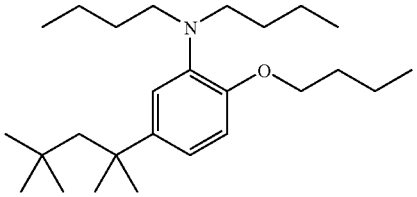
ST-6
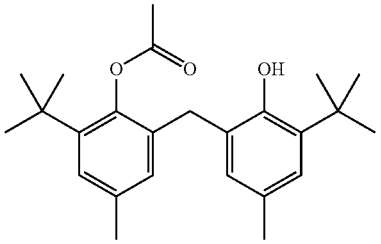
ST-7
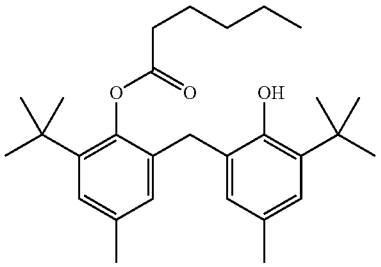
ST-8
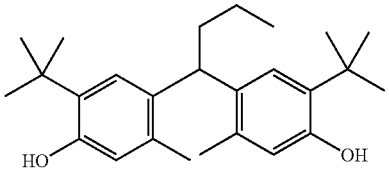

-continued
ST-9
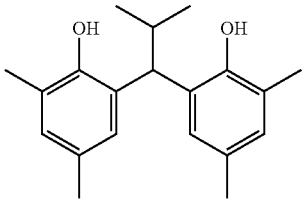
ST-10
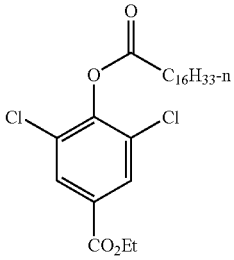
ST-11
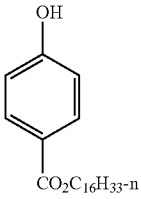
ST-12
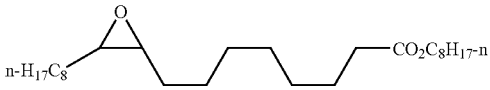
ST-13
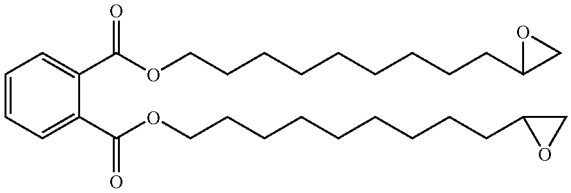
ST-14
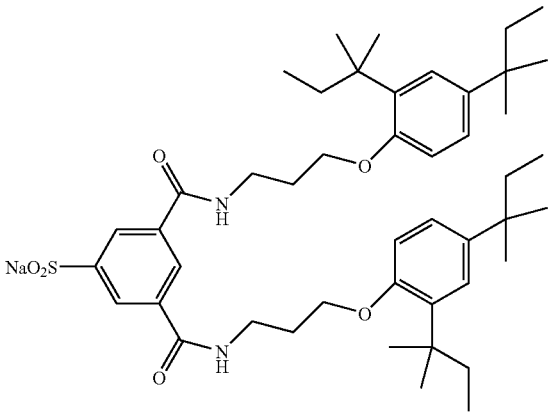
ST-15
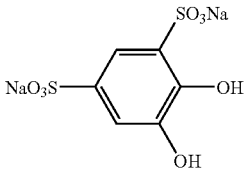

-continued
ST-16
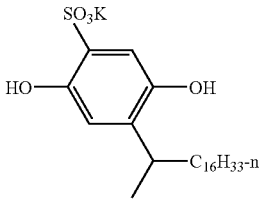
ST-17
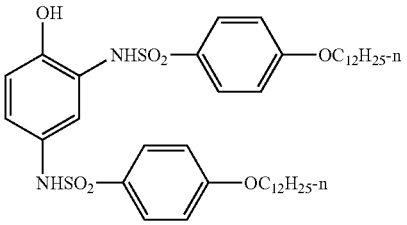
ST-18
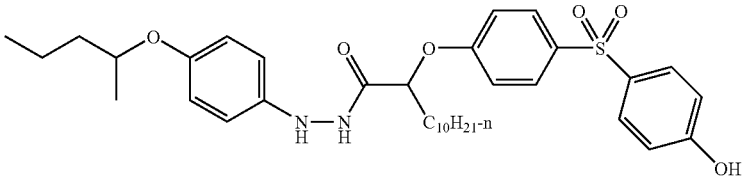
ST-19
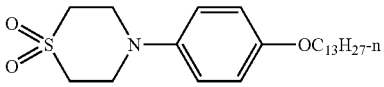
ST-20
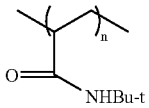
n = 75–8,000
ST-21
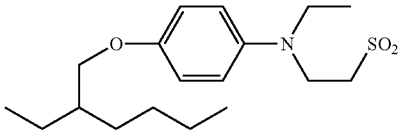
ST-22
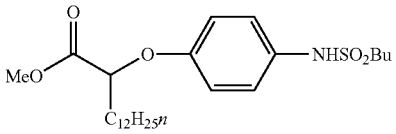
ST-23
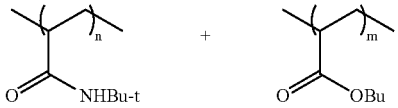
n:m 1:1 mw = 75–100,000
ST-24
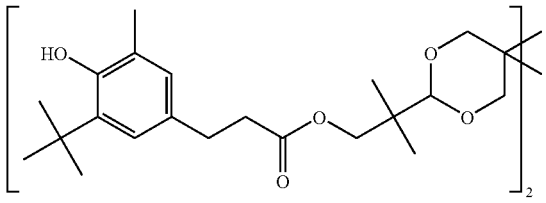

-continued

ST-25

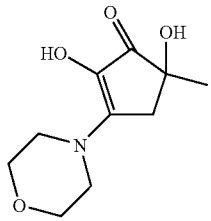

Examples of solvents which may be used in the invention include the following:

Tritolyl phosphate S-1

Dibutyl phthalate S-2

Diundecyl phthalate S-3

N,N-Diethyldodecanamide S-4

N,N-Dibutyldodecanamide S-5

Tris(2-ethylhexyl)phosphate S-6

Acetyl tributyl citrate S-7

2,4-Di-tert-pentylphenol S-8

2-(2-Butoxyethoxy)ethyl acetate S-9

1,4-Cyclohexyldimethylene bis(2-ethylhexanoate) S-10 decanedioic acid, dibutyl ester S-11

The dispersions and overcoat layers used in photographic elements useful with the present invention may also include ultraviolet (UV) stabilizers and so-called liquid UV stabilizers such as described in U.S. Pat. Nos. 4,992,358; 4,975,360; and 4,587,346, incorporated herein by reference. Examples of UV stabilizers are shown below. Preferred are the polymeric UV agents, when used in the overcoat layer. PUV-1, PUV-2, and PUV-3 are preferred for use in the overcoat, as they provide excellent UV protection at low amounts. Polymeric UV agents in the overcoat may be combined with non-polymeric UV agents in interlayers and dye-forming layer. A UV absorber may also be included in the cyan layer or in a layer above the dye-forming layers. A layer between the surface SOC layer and the upper image forming layer may also be effective UV control. The placement of UV absorbers in the upper surface protective layer (SOC layer) is also useful, as they are most effective in this layer and a separate overlayer coating is not required.

UV-1

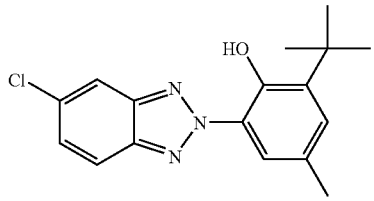

UV-2

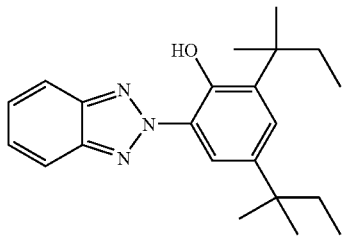

-continued

UV-3

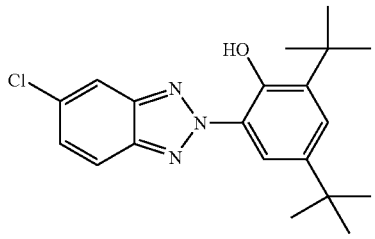

UV-4

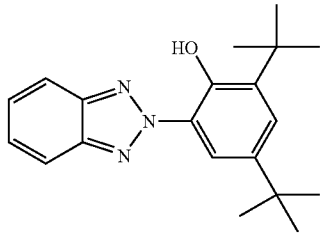

UV-5

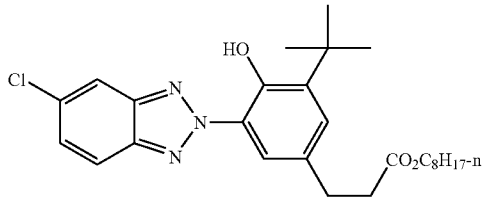

UV-6

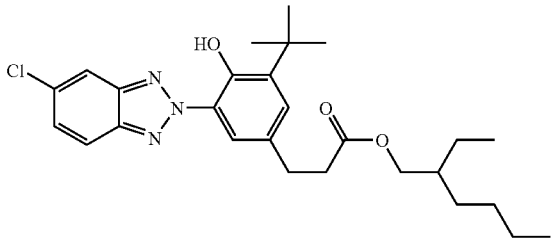

UV-7

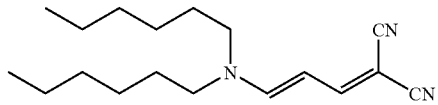

UV-8

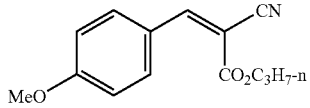

The aqueous phase may include surfactants. Surfactant may be cationic, anionic, zwitterionic or non-ionic. Useful surfactants include, but are not limited to, the following:

SF-1

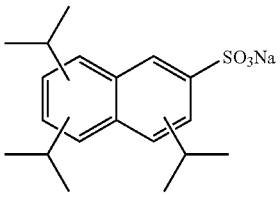

SF-2

$CF_3 \cdot (CF_2)_7 \cdot SO_3Na$

SF-3

$CH_3 \cdot (CH_2)_n \cdot SO_3Na$, n = 12–14

SF-4

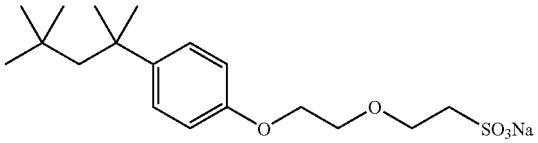

SF-5

$CH_3 \cdot (CH_2)_{11} \cdot OSO_3Na$

SF-6

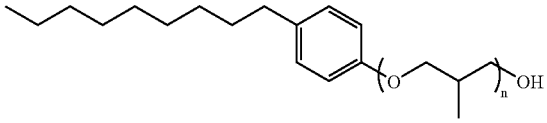

n = ca. 10

SF-7

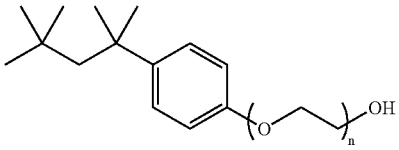

n = ca. 40

SF-8

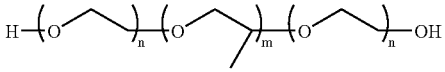

n = ca. 6, m = ca. 2

SF-9

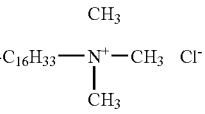

SF-10

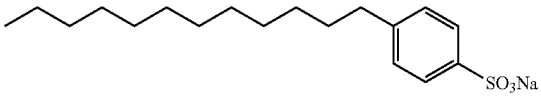

SF-11

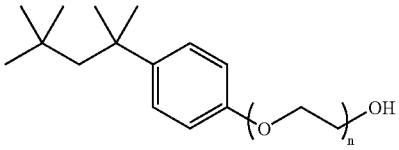

n = ca. 10

-continued

SF-12

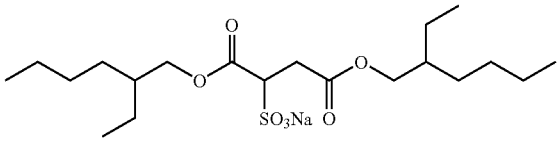

Further, it is contemplated to stabilize photographic dispersions prone to particle growth through the use of hydrophobic, photographically inert compounds such as disclosed by Zengerle et al U.S. Pat. No. 5,468,604, incorporated herein by reference.

The photographic elements may also contain filter dye layers comprising colloidal silver sol or yellow, cyan, and/or magenta filter dyes, either as oil-in-water dispersions, latex dispersions or as solid particle dispersions. Useful examples of absorbing materials are discussed in Research Disclosure, September 1996, Item 38957, Section VIII.

The photographic elements may also contain light absorbing materials that can increase sharpness and be used to control speed and minimum density. Examples of useful absorber dyes are described in U.S. Pat. No. 4,877,721, U.S. Pat. No. 5,001,043, U.S. Pat. No. 5,153,108, and U.S. Pat. No. 5,035,985, all incorporated herein by reference. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; 5,266,454, all incorporated herein by reference. Useful dyes include, but are not limited to, the following structures.

Dye-1

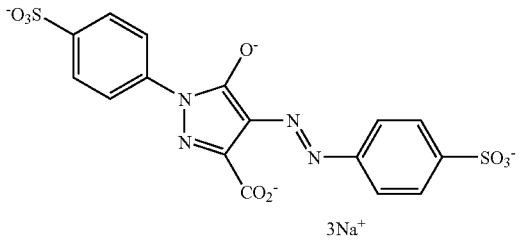

Dye-2

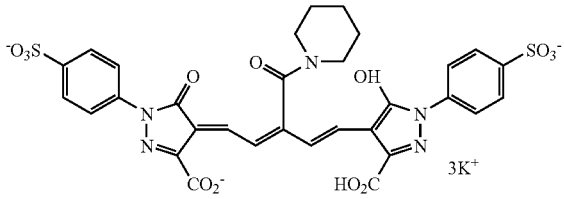

Dye-3

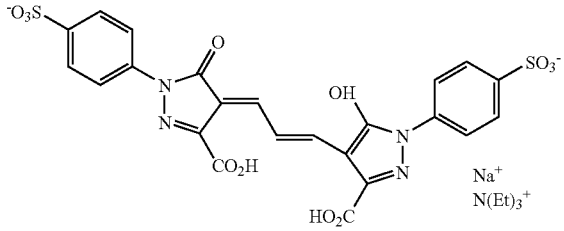

In a preferred embodiment the invention may employ recording elements which are constructed to contain at least three silver halide emulsion and preferably eight layer units. A suitable full color, multilayer format for a recording element used in the invention is represented by Structure I.

| STRUCTURE I |
| --- |
| Overcoat |
| UV Layer Containing UV light-absorbing materials |
| Red-sensitized cyan dye image-forming silver halide emulsion unit |
| Interlayer |
| Green-sensitized magenta dye image-forming silver halide emulsion unit |
| Interlayer |
| Blue-sensitized yellow dye image-forming silver halide emulsion unit |
| ///// Support ///// |

The image-forming units are separated from each other by hydrophilic colloid interlayers containing an oxidized developing agent scavenger to prevent color contamination. Silver halide emulsions satisfying the grain and gelatino-peptizer requirements described above may be present in any one or combination of the emulsion layer units. Additional useful multicolor, multilayer formats for an element used with the invention include structures as described in U.S. Pat. No. 5,783,373. Each of such structures in accordance with the invention preferably would contain silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that may be incorporated into multilayer (and particularly multicolor) recording elements contemplated for use in the invention are illustrated by *Research Disclosure*, Item 38957, incorporated herein by reference, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers useful with this invention may be conventionally optically printed, or in accordance with a particular embodiment of the invention may be image-wise exposed in a pixel-by-pixel mode using suitable high energy radiation sources typically employed in electronic printing methods. Suitable actinic forms of energy encompass the ultraviolet, visible, and infrared regions of the electromagnetic spectrum, as well as electron-beam radiation and is conveniently supplied by beams from one or more light emitting diodes or lasers, including gaseous or solid state lasers. Exposures may be monochromatic, orthochromatic, or panchromatic. For example, when the recording element is a multilayer multicolor element, exposure may be provided by laser or light emitting diode beams of appropriate spectral radiation, for example, infrared, red, green or blue wavelengths, to which such element is sensitive. Multicolor elements may be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. Suitable light emitting diodes and commercially available laser sources are known and commercially available. Imagewise exposures at ambient, elevated, or reduced temperatures and/or pressures may be employed within the useful response range of the recording element determined by conventional sensitometric techniques, as illustrated by T. H. James, *The Theory of the Photographic Process,* 4th Ed., Macmillan, 1977, Chapters 4, 6, 17, 18, and 23, incorporated herein by reference.

It has been observed that anionic $[MX_xY_yL_z]$ hexacoordination complexes, where M is a group 8 or 9 metal (preferably iron, ruthenium or iridium), X is halide or pseudohalide (preferably Cl, Br, or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in an improving latent image keeping (LIK). As herein employed, HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 500 seconds. Although these advantages may be generally compatible with face centered cubic lattice grain structures, the most striking improvements have been observed in high (>50 mole %, preferably ≧90 mole %) chloride emulsions. Preferred C—C, H—C, or C—N—H organic ligands are aromatic heterocycles of the type described in U.S. Pat. No. 5,462,849, incorporated herein by reference. The most effective C—C, H—C, or C—N—H organic ligands are azoles and azines, either unsubstituted or containing alkyl, alkoxy, or halide substituents, where the alkyl moieties contain from 1 to 8 carbon atoms. Particularly preferred azoles and azines include thiazoles, thiazolines, and pyrazines.

The quantity or level of high energy actinic radiation provided to the recording medium by the exposure source is generally at least $10^{-4}$ ergs/cm$^2$, typically from $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100μ seconds, often up to 10μ seconds, and frequently up to only 0.5μ seconds. Single or multiple exposures of each pixel are contemplated. The pixel density is subject to wide variation, as is obvious to those skilled in the art. The higher the pixel density, the sharper the images may be, but at the expense of equipment complexity. In general, pixel densities used in conventional electronic printing methods of the type described herein do not exceed $10^7$ pixels/cm$^2$ and are typically from $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, incorporated herein by reference. As previously indicated herein, a description of some of the details of conventional electronic printing methods comprising scanning a recording element with high energy beams such as light emitting diodes or laser beams, is set forth in Hioki U.S. Pat. No. 5,126,235 and European Patent Applications 479 167 A1 and 502 508 A1, all incorporated herein by reference.

Once imagewise exposed, the recording elements may be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing, and stabilizing

In addition, a useful developer for the inventive material is a homogeneous, single-part developing agent. The homogeneous, single-part color developing concentrate is prepared using a sequence of steps:

In the first step, an aqueous solution of a suitable color developing agent is prepared. This color developing agent is generally in the form of a sulfate salt. Other components of the solution may include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from 15:85 to 50:50.

In this environment, especially at high alkalinity, alkali metal ions and sulfate ions form a sulfate salt that is precipitated in the presence of the hydroxy-containing organic solvent. The precipitated sulfate salt may then be readily removed using any suitable liquid/solid phase separation technique (including filtration, centrifugation, or decantation). If the antioxidant is a liquid organic compound, two phases may be formed and the precipitate may be removed by discarding the aqueous phase.

The color developing concentrates useful with this invention include one or more color developing agents that are well known in the art that, in oxidized form, will react with dye-forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993), incorporated herein by reference. It may be useful for the color developing agents to have one or more water-solubilizing groups as are known in the art. Further details of such materials are provided in *Research Disclosure*, 38957, pages 592–639 (September 1996), incorporated herein by reference. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-σ-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants may be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants may also be used if desired.

Especially useful antioxidants are hydroxylamine derivatives as described, for example, in U.S. Pat. Nos. 4,892,804; 4,876,174; 5,354,646; and 5,660,974, all noted above, and U.S. Pat. No. 5,646,327 (Burns et al), incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

More preferably, the noted hydroxylamine derivatives may be mono- or dialkylhydroxylamines having one or more hydroxy substituents on the one or more alkyl groups. Representative compounds of this type are described, for example, in U.S. Pat. No. 5,709,982 (Marrese et al), incorporated herein by reference, as having the structure AI:

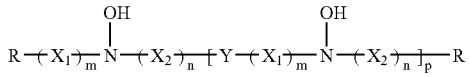

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is $—CR_2(OH)CHR_1—$ and $X_2$ is $—CHR_1CR_2(OH)—$ wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure AI, m, n, and p are independently 0 or 1. Preferably, each of m and n is 1, and p is 0. Specific di-substituted hydroxylamine antioxidants include, but are not limited to, N,N-bis(2,3-dihydroxypropyl)hydroxylamine, N,N-bis(2-methyl-2,3-dihydroxypropyl)hydroxylamine, and N,N-bis(1-hydroxymethyl-2-hydroxy-3-phenylpropyl)hydroxylamine. The first compound is preferred.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND, incorporated herein by reference. The Table and the references cited in the Table are to be read as describing particular components suitable for use with the invention. The Table and its cited references also describe suitable ways of preparing, exposing, processing and manipulating the elements, and the images contained therein.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, |
| | I, II, III, IX | coating aids, addenda |
| 3 | A & B | |
| 1 | III, IV | Chemical sensitization and |
| 2 | III, IV | spectral sensitization/ |
| 3 | IV, V | Desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements may be exposed with various forms of energy which encompass the ultraviolet, visible, and infrared regions of the electromagnetic spectrum, as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they may include features found in conventional radiographic element.

This allows for traditional image processing equipment to be used. The imaging elements of this invention may be exposed via traditional optical methods using a negative, but they are preferably exposed by means of a collimated beam, to form a latent image, and then processed to form a visible image, preferably by other than heat treatment. A collimated beam is preferred as it allows for digital printing and simultaneous exposure of the imaging layer on the top and bottom side without significant internal light scatter. A preferred example of a collimated beam is a laser also known as light amplification by stimulated emission of radiation. The laser may be preferred because this technology is used widely in a number of digital printing equipment types. Further, the laser provides sufficient energy to simultaneously expose the light sensitive silver halide coating on the top and bottom side of the display material without undesirable light scatter. Subsequent processing of the latent image into a visible image is preferably carried out in the known RA-4™ (Eastman Kodak Company) process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLE 1

Silver chloride emulsions were chemically and spectrally sensitized in the following manner. The Blue Sensitive Emulsion (Blue EM-1, which will be referred to as Blue Silver) was prepared similarly to that described in U.S. Pat. No. 5,252,451, column 8, lines 55–68, incorporated herein by reference: A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by the addition of Ru and Ir dopants. Small amount of iodide was also added towards the end of precipitation process. The resultant emulsion contained cubic shaped grains of 0.55 μm in edge length size. This emulsion was optimally sensitized by the addition of water soluble gold, sulfur and selenium sensitizers and heat ramped up to 60° C., during which time blue sensitizing dye BSD-4, 1-(3-acetamidophenyl)-5-mercaptotetrazole, and Lippmann bromide were added. In addition, iridium dopant was added during the sensitization process.

The Green Sensitive Emulsion (Green EM-1, which will be referred to as Green Silver) was prepared in the following manner. A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by Ir dopant. The resultant emulsion contained cubic shaped grains of 0.30 μm in edge length size. This emulsion was optimally sensitized by addition of water soluble gold and sulfur sensitizers, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole. In addition, iridium dopant was added during the sensitization process.

Red Sensitive Emulsion (Red EM-1, which will be referred to as Red Silver)) was prepared in the following manner. A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for the first part of the precipitation, followed by the addition of Ru and Ir dopants. The resultant emulsion contained cubic shaped grains of 0.40 μm in edge length size. This emulsion was optimally sensitized by the addition of of water soluble gold and sulfur sensitizers followed by a heat ramp, and further additions of 1-(3-acetamidophenyl)-5-mercaptotetrazole, potassium bromide and red sensitizing dye RSD-1. In addition, iridium dopant was added during the sensitization process.

Cyan, magenta, and yellow couplers corresponding to IC-35, M-3, and Y-1 were used as dispersions. Coupler dispersions were emulsified by methods well known to the art.

Coating examples 1-1 through 1-14 were made having the multilayer structure of shown in Table 1. Layers were coated on a polyethylene resin coated paper support, which was sized as described in U.S. Pat. No. 4,994,147, incorporated herein by reference, and pH adjusted as described in U.S. Pat. No. 4,917,994, incorporated herein by reference. The polyethylene layer coated on the emulsion side of the support contained a mixture of 0.1% (4,4'-bis(5-methyl-2-benzoxazolyl)stilbene and 4,4'-bis(2-benzoxazolyl)stilbene, 12.5% $TiO_2$, and 3% ZnO white pigment. Table 2 lists the amounts of the components in the multilayer structure, except that the amounts of the upper and lower scavenger level; cyan, magenta, and yellow silver; and cyan, magenta, and yellow coupler levels; and the UV dye level are given in Table 3a and Table 3b. The layers were hardened with bis(vinylsulfonyl) methyl at 1.65% of the total gelatin weight.

TABLE 1

Multilayer Structure of Inventive and Comparison Examples.

| LAYER | |
|---|---|
| 7 | Overcoat |
| 6 | UV Layer Containing UV Dispersions |
| 5 | Red Light Sensitive Layer Containing Cyan Silver and Cyan Coupler |
| 4 | Upper Interlayer Containing Scavenger |
| 3 | Green Light Sensitive Layer Containing Magenta Silver and Magenta Coupler |
| 2 | Lower Interlayer Containing Scavenger |
| 1 | Blue Light Sensitive Layer Containing Yellow Silver and Yellow Coupler |
| 0 | Support |

TABLE 2

Detailed Coating Structure of Inventive and Comparison Examples.

| | $g/m^2$ | $mg/ft^2$ |
|---|---|---|
| Layer 7: Overcoat | | |
| Gelatin | 0.565 | 51.4 |
| SF-1 | 0.011 | 1.00 |
| α-Hydro-ω-hydroxypoly(oxy-1,2-ethanediyl) | 0.002 | 0.19 |
| Dow Corning © 200 Fluid | 0.202 | 1.88 |
| Ludox ® | 0.242 | 22.50 |
| Dye-1 | 0.005 | 0.46 |
| Dye-2 | 0.009 | 0.85 |
| Dye-3 | 0.011 | 1.04 |
| Layer 6: UV Layer | | |
| Gelatin | 0.242 | 22.50 |
| UV-1 | 0.065 | 6.03 |
| UV-2 | 0.011 | 1.07 |
| S-6 | 0.072 | 6.66 |
| SF-1 | 0.008 | 0.74 |
| Layer 5: Red Light Sensitive Layer | | |
| Gelatin | 1.202 | 111.71 |
| Cyan Silver (Red EM-3) | See Table 3c | |
| Cyan Coupler (IC-35) | See Table 3b | |
| S-6 | 0.090 | 8.40 |
| S-11 | 0.451 | 41.87 |
| UV-2 | 0.331 | 30.72 |
| SF-1 | 0.046 | 4.24 |
| Potassium tolylthiosulfonate | 0.002 | 0.20 |
| ST-24 | 0.00054 | 0.050 |
| Layer 4: Upper Interlayer | | |
| Gelatin | 0.678 | 62.99 |
| Scavenger (ST-4) | See Table 3a | |
| S-1 | 0.174 | 16.2 |
| SF-1 | 0.007 | 0.67 |
| ST-15 | 0.028 | 2.59 |

TABLE 2-continued

Detailed Coating Structure of Inventive and Comparison Examples.

| | $g/m^2$ | $mg/ft^2$ |
|---|---|---|
| Layer 3: Green Light Sensitive Layer | | |
| Gelatin | 0.881 | 81.80 |
| Magenta Silver (Green EM-3) | See Table 3c | |
| Magenta Coupler (M-3) | See Table 3b | |
| S-1 | 0.108 | 10.00 |
| ST-21 | 0.011 | 1.00 |
| S-3 | 0.059 | 5.44 |
| S-6 | 0.108 | 10.00 |
| S-11 | 0.157 | 14.56 |
| ST-24 | 5.7e−4 | 0.05 |
| SF-1 | 0.030 | 2.77 |
| Layer 2: Lower Interlayer | | |
| Gelatin | 0.734 | 68.23 |
| Scavenger (ST-4) | See Table 3a | |
| S-1 | 0.189 | 17.55 |
| SF-1 | 0.008 | 0.73 |
| ST-15 | 0.030 | 2.81 |
| BVSM Hardener | 0.087 | 8.06 |
| Layer 1: Blue Light Sensitive Layer | | |
| Gelatin | 0.955 | 88.72 |
| Blue Light Sensitive Silver (BlueEM-3) | See Table 3c | |
| Yellow Coupler (Y-5) | See Table 3b | |
| Potassium Chloride | 0.021 | 1.90 |
| S-7 | 0.214 | 19.84 |
| ST-6 | 0.075 | 6.96 |
| ST-26 | 0.075 | 6.96 |
| ST-21 | 0.075 | 6.96 |
| SF-1 | 0.048 | 4.42 |
| ST-25 | 0.007 | 0.64 |
| ST-16 | 0.001 | 0.10 |
| Support | | |

TABLE 3a

Scavenger levels ($mmol/m^2$) for Example 1, coatings 1-1 through 1-14.

| Example | Upper Scavenger Level | Lower Scavenger Level | Total Scavenger Level |
|---|---|---|---|
| 1-1 | 0.39 | 0.42 | 0.80 |
| 1-2 | 0.39 | 0.42 | 0.80 |
| 1-3 | 0.33 | 0.36 | 0.69 |
| 1-4 | 0.27 | 0.29 | 0.56 |
| 1-5 | 0.21 | 0.23 | 0.44 |
| 1-6 | 0.15 | 0.17 | 0.32 |
| 1-7 | 0.10 | 0.11 | 0.20 |
| 1-8 | 0.35 | 0.38 | 0.72 |
| 1-9 | 0.35 | 0.38 | 0.72 |
| 1-10 | 0.30 | 0.32 | 0.61 |
| 1-11 | 0.24 | 0.26 | 0.51 |
| 1-12 | 0.19 | 0.21 | 0.40 |
| 1-13 | 0.14 | 0.15 | 0.29 |
| 1-14 | 0.09 | 0.09 | 0.18 |

TABLE 3b

Coupler levels ($mmol/m^2$) for Example 1, coatings 1-1 through 1-14.

| Example | Cyan Coupler Level | Magenta Coupler Level | Yellow Coupler Level | Total Coupler Level |
|---|---|---|---|---|
| 1-1 | 0.33 | 0.24 | 0.63 | 1.19 |
| 1-2 | 0.33 | 0.20 | 0.63 | 1.16 |

TABLE 3b-continued

| Example | Coupler levels (mmol/m$^2$) for Example 1, coatings 1-1 through 1-14. Cyan Coupler Level | Magenta Coupler Level | Yellow Coupler Level | Total Coupler Level |
|---|---|---|---|---|
| 1-3 | 0.29 | 0.20 | 0.63 | 1.12 |
| 1-4 | 0.29 | 0.20 | 0.63 | 1.12 |
| 1-5 | 0.29 | 0.20 | 0.63 | 1.12 |
| 1-6 | 0.29 | 0.20 | 0.63 | 1.12 |
| 1-7 | 0.29 | 0.20 | 0.63 | 1.12 |
| 1-8 | 0.33 | 0.24 | 0.63 | 1.19 |
| 1-9 | 0.33 | 0.24 | 0.63 | 1.19 |
| 1-10 | 0.33 | 0.20 | 0.63 | 1.16 |
| 1-11 | 0.33 | 0.20 | 0.63 | 1.16 |
| 1-12 | 0.33 | 0.20 | 0.63 | 1.16 |
| 1-13 | 0.33 | 0.20 | 0.63 | 1.16 |
| 1-14 | 0.33 | 0.20 | 0.63 | 1.16 |

TABLE 3c

Silver levels (mmol/m$^2$) for Example 1, coatings 1-1 through 1-14.

| Coating | Cyan Silver Level | Magenta Silver Level | Yellow Silver Level | Total Silver Level | Coupler/ Silver Ratio |
|---|---|---|---|---|---|
| 1-1 | 1.51 | 1.05 | 1.73 | 4.29 | 0.28 |
| 1-2 | 1.09 | 1.07 | 1.66 | 3.82 | 0.30 |
| 1-3 | 1.09 | 1.07 | 1.66 | 3.82 | 0.29 |
| 1-4 | 1.09 | 1.07 | 1.66 | 3.82 | 0.29 |
| 1-5 | 1.09 | 1.07 | 1.66 | 3.82 | 0.29 |
| 1-6 | 1.09 | 1.07 | 1.66 | 3.82 | 0.29 |
| 1-7 | 1.09 | 1.07 | 1.66 | 3.82 | 0.29 |
| 1-8 | 1.41 | 1.41 | 1.67 | 4.50 | 0.26 |
| 1-9 | 1.02 | 1.02 | 1.61 | 3.64 | 0.33 |
| 1-10 | 1.02 | 1.02 | 1.61 | 3.64 | 0.32 |
| 1-11 | 1.02 | 1.02 | 1.61 | 3.64 | 0.32 |
| 1-12 | 1.02 | 1.02 | 1.61 | 3.64 | 0.32 |
| 1-13 | 1.02 | 1.02 | 1.61 | 3.64 | 0.32 |
| 1-14 | 1.02 | 1.02 | 1.61 | 3.64 | 0.32 |

To evaluate the coatings, prints were made by exposing the coatings with a conventional tungsten light source using a test pattern negative. Development was 45 seconds in a standard RA4 process.

CIE 1976 (L* a* b*) color space (CIELAB), was used to evaluate the coatings. CIELAB allows the specification of color perceptions in terms of a three-dimensional space. The L*-axis is known as the lightness and extends from 0 (black) to 100 (white). The other two coordinates a* and b* represent redness-greenness and yellowness-blueness respectively. Samples for which a*=b*=0 are achromatic and thus the L*-axis represents the achromatic scale of grays from black to white.

In order to evaluate the fringing propensity of the example coatings, a fringing metric was determined for each coating in the following manner. An image file containing both vertical and horizontal lines of maximum density on a minimum density background in a 1-on and 2-off pattern was printed on a coating using a digital photographic writer. After processing, this creates a pattern of alternating lines of maximum and minimum density. CIE L* a* b* measurements (integral) were taken from each set of lines on the print. The line data was averaged. The a* and b* values were weighted for color preference prior to calculations. Parameter F1, which represents the vector length of the color difference from a perfect neutral, is calculated from equation (1). Next, parameter F2, which represents the vector length of the total color difference from a perfect lightness and neutral position, is calculated from equation 2. The Fringe Metric is then calculated from equation 3. This metric correlates well with perceived "fringing" in digitally printed photographs and text. The lower the value of the Fringe Metric, the less likely fringing will be observed. Values of the Fringe Metric for the example coatings are reported in Table 3d.

$$F1=(a^{*2}+b^{*2})^{1/2} \quad \text{(eq. 1)}$$

$$F2=((66-L^*)^2+a^{*2}+b^{*2})^{1/2} \quad \text{(eq. 2)}$$

$$\text{Fringe Metric}=F1+F2 \quad \text{(eq. 3)}$$

In order to evaluate the color of the example coatings, a color metric was calculated in the following manner. An image file, containing patches of primary and secondary colors of varying lightness, was printed on a coating using a digital photographic writer. After processing, CIE L* a* b* measurements (integral) were taken from the print. The parameter C1, which represents the vector length of the color difference from a perfect neutral, was calculated from equation 4 for each primary and secondary color, including the colors yellow, blue, magenta, green, cyan, and red. The color metric, which represents the average across colors of each color's maximum C1 position, was calculated from equation 5. This metric correlates well to perceived "color extent" or capability in digitally printed photographs. Higher values of the Color Metric are preferred, however, a metric value of about 60 or above is considered acceptable. Values of the Color Metric for the example coatings are reported in Table 3d.

$$C1=(a^{*2}+b^{*2})^{1/2} \quad \text{(eq. 4)}$$

$$\text{Color Metric}=(C1(\text{yellow})+C1(\text{blue})+C1(\text{magenta})+C1(\text{green})+C1(\text{cyan})+C1(\text{red}))/6 \quad \text{(eq. 5)}$$

The L* value at maximum density (Dmax) was also determined from prints of the example coatings. The L* value inversely correlates with darkness. At Dmax, it is desirable to obtain a very dark color, consequently low values of this parameter are preferred. The corresponding values, at maximum density, for L* are reported in Table 3d as DmaxL*.

TABLE 3d

Evaluation of Example 1 coatings 1-1 through 1-14.

| Example | Silver Level Change | Scavenger/ Silver Ratio | Scavenger/ Coupler Ratio | Color Metric | Dmax L* | Fringe Metric | Relative Fringe Metric |
|---|---|---|---|---|---|---|---|
| 1-1 (Comparison) | 0% | 0.19 | 0.68 | 73 | 8.1 | 108 | 100 |

TABLE 3d-continued

Evaluation of Example 1 coatings 1-1 through 1-14.

| Example | Silver Level Change | Scavenger/ Silver Ratio | Scavenger/ Coupler Ratio | Color Metric | Dmax L* | Fringe Metric | Relative Fringe Metric |
|---|---|---|---|---|---|---|---|
| 1-2 (Comparison) | −11% | 0.21 | 0.69 | 73 | 9.6 | 114 | 106 |
| 1-3 (Comparison) | −11% | 0.18 | 0.61 | 72 | 9.9 | 89 | 82 |
| 1-4 (Invention) | −11% | 0.15 | 0.50 | 71 | 9.0 | 89 | 82 |
| 1-5 (Invention) | −11% | 0.12 | 0.40 | 70 | 9.2 | 68 | 63 |
| 1-6 (Invention) | −11% | 0.08 | 0.29 | 67 | 8.6 | 54 | 50 |
| 1-7 (Invention) | −11% | 0.05 | 0.18 | 61 | 9.3 | 66 | 61 |
| 1-8 (Comparison) | 5% | 0.16 | 0.61 | 73 | 8.0 | 101 | 94 |
| 1-9 (Comparison) | −15% | 0.20 | 0.61 | 73 | 10.0 | 121 | 112 |
| 1-10 (Comparison) | −15% | 0.17 | 0.53 | 72 | 9.5 | 129 | 119 |
| 1-11 (Invention) | −15% | 0.14 | 0.44 | 71 | 9.4 | 97 | 90 |
| 1-12 (Invention) | −15% | 0.11 | 0.34 | 69 | 9.3 | 92 | 85 |
| 1-13 (Invention) | −15% | 0.08 | 0.25 | 66 | 8.9 | 91 | 84 |
| 1-14 (Invention) | −15% | 0.05 | 0.16 | 61 | 8.3 | 77 | 71 |

Example 1-1 has a high level of total silver (4.29 mmol/$m^2$, Table 3c) and a high scavenger/coupler ratio (0.68, Table 3d). Example 1-2 shows the effect of reducing silver by 11% without significantly changing the scavenger/coupler ratio. The relative Fringing Metric increases. The Dmax L* also increases relative to Example 1, indicating a lighter Dmax color. Example 1-3 shows the effect of reducing silver (11%) and a small reduction in the scavenger/coupler ratio relative to Example 1-1. In this case the Fringing Metric does decrease, however the Dmax L* value increases even further than in Example 1-2. Example 1-4, wherein the coupler/scavenger ratio is 0.5, exhibits both a smaller fringing metric and an acceptable Dmax L* value. However, Inventive examples 1-5 through 1-7 indicate the effect of lowering the scavenger/coupler ratio to even more desirable levels. The Fringing Metric becomes relatively low (about a 40–50% reduction relative to Example 1-1), even though silver has been reduced by 11%. This desirable range also corresponds to a scavenger/silver ratio between 0.05 and 0.15.

In a similar fashion, Examples 1-9 through 1-14 show the effect of reducing the silver by 15% relative to Example 1-1. In examples 1-9 and 1-10, silver is reduced while the scavenger/coupler ratio is somewhat reduced but still high. The fringing metric remains very high with these examples, as does the Dmax L* value. When the coupler/silver ratio reaches 0.44, as in Example 1-11, the fringing metric is reduced significantly and the Dmax L* value is also reduced. Inventive examples 1-12 through 1-14 illustrate the effect of reducing the coupler/scavenger ratio even more. The Fringing Metric and the Dmax L* metric are further improved, while color reproduction remains acceptable. Thus, desirable effects can be achieved by keeping the scavenger/coupler ratio between 0.15 and 0.45. Desirably the silver/coupler ratio is between 0.05 and 0.15.

EXAMPLE 2

Photographic coating 2-1 through 2-25 were prepared in the same manner as in Example 1, except the scavenger levels are given in Table 4a. The UV Dye, and the Cyan, Magenta, and Yellow Coupler levels are given in Table 4b. Silver variations are listed in Table 4c.

TABLE 4a

Scavenger levels (mmol/$m^2$) for Example 2.

| Example | Upper Scavenger | Lower Scavenger | Total Scavenger |
|---|---|---|---|
| 2-1 | 0.35 | 0.38 | 0.72 |
| 2-2 | 0.35 | 0.38 | 0.72 |
| 2-3 | 0.35 | 0.38 | 0.72 |
| 2-4 | 0.35 | 0.38 | 0.72 |
| 2-5 | 0.35 | 0.38 | 0.72 |
| 2-6 | 0.35 | 0.38 | 0.72 |
| 2-7 | 0.11 | 0.12 | 0.22 |
| 2-8 | 0.35 | 0.38 | 0.72 |
| 2-9 | 0.11 | 0.12 | 0.22 |
| 2-10 | 0.35 | 0.38 | 0.72 |
| 2-11 | 0.35 | 0.38 | 0.72 |
| 2-12 | 0.35 | 0.38 | 0.72 |
| 2-13 | 0.35 | 0.38 | 0.72 |
| 2-14 | 0.35 | 0.38 | 0.72 |
| 2-15 | 0.35 | 0.38 | 0.72 |
| 2-16 | 0.11 | 0.12 | 0.22 |
| 2-17 | 0.11 | 0.12 | 0.22 |
| 2-18 | 0.11 | 0.12 | 0.22 |
| 2-19 | 0.35 | 0.38 | 0.72 |
| 2-20 | 0.35 | 0.38 | 0.72 |
| 2-21 | 0.35 | 0.38 | 0.72 |
| 2-22 | 0.35 | 0.38 | 0.72 |
| 2-23 | 0.35 | 0.38 | 0.72 |
| 2-24 | 0.11 | 0.12 | 0.22 |
| 2-25 | 0.11 | 0.12 | 0.22 |

TABLE 4b

| Example | UV Dye ($g/m^2$) and Coupler levels ($mmol/m^2$), UV Dye | Cyan Coupler | Magenta Coupler | Yellow Coupler | Total Coupler |
|---|---|---|---|---|---|
| 2-1 | 7.10 | 0.33 | 0.24 | 0.63 | 1.19 |
| 2-2 | 7.10 | 0.33 | 0.24 | 0.63 | 1.19 |
| 2-3 | 7.10 | 0.33 | 0.24 | 0.63 | 1.19 |
| 2-4 | 3.80 | 0.30 | 0.20 | 0.56 | 1.06 |
| 2-5 | 3.80 | 0.30 | 0.20 | 0.56 | 1.06 |
| 2-6 | 3.80 | 0.30 | 0.20 | 0.56 | 1.06 |
| 2-7 | 3.80 | 0.30 | 0.20 | 0.56 | 1.06 |
| 2-8 | 7.10 | 0.33 | 0.24 | 0.63 | 1.19 |
| 2-9 | 3.80 | 0.30 | 0.20 | 0.56 | 1.06 |
| 2-10 | 7.10 | 0.33 | 0.24 | 0.63 | 1.19 |
| 2-11 | 7.10 | 0.33 | 0.24 | 0.63 | 1.19 |
| 2-12 | 7.10 | 0.33 | 0.24 | 0.63 | 1.19 |
| 2-13 | 3.80 | 0.30 | 0.20 | 0.56 | 1.06 |
| 2-14 | 3.80 | 0.30 | 0.20 | 0.56 | 1.06 |
| 2-15 | 3.80 | 0.30 | 0.20 | 0.56 | 1.06 |
| 2-16 | 3.80 | 0.30 | 0.20 | 0.56 | 1.06 |
| 2-17 | 3.80 | 0.30 | 0.20 | 0.56 | 1.06 |
| 2-18 | 3.80 | 0.30 | 0.20 | 0.56 | 1.06 |
| 2-19 | 7.10 | 0.33 | 0.24 | 0.63 | 1.19 |
| 2-20 | 7.10 | 0.33 | 0.24 | 0.63 | 1.19 |
| 2-21 | 7.10 | 0.33 | 0.24 | 0.63 | 1.19 |
| 2-22 | 3.80 | 0.30 | 0.20 | 0.56 | 1.06 |
| 2-23 | 3.80 | 0.30 | 0.20 | 0.56 | 1.06 |
| 2-24 | 3.80 | 0.30 | 0.20 | 0.56 | 1.06 |
| 2-25 | 3.80 | 0.30 | 0.20 | 0.56 | 1.06 |

TABLE 4c

| Example | Silver variations for Examples 2. Cyan Silver | Magenta Silver | Yellow Silver | Total Silver |
|---|---|---|---|---|
| 2-1 | 1.70 | 0.98 | 1.66 | 4.34 |
| 2-2 | 1.43 | 0.98 | 1.66 | 4.07 |
| 2-3 | 1.23 | 0.98 | 1.66 | 3.87 |
| 2-4 | 1.49 | 0.81 | 1.51 | 3.81 |
| 2-5 | 1.28 | 0.81 | 1.51 | 3.60 |
| 2-6 | 1.12 | 0.81 | 1.51 | 3.44 |
| 2-7 | 1.49 | 0.81 | 1.51 | 3.81 |
| 2-8 | 1.28 | 0.81 | 1.51 | 3.60 |
| 2-9 | 1.12 | 0.81 | 1.51 | 3.44 |
| 2-10 | 1.43 | 1.13 | 1.66 | 4.23 |
| 2-11 | 1.43 | 0.98 | 1.66 | 4.07 |
| 2-12 | 1.43 | 0.86 | 1.66 | 3.95 |
| 2-13 | 1.28 | 0.92 | 1.51 | 3.71 |
| 2-14 | 1.28 | 0.81 | 1.51 | 3.60 |
| 2-15 | 1.28 | 0.73 | 1.51 | 3.52 |
| 2-16 | 1.28 | 0.92 | 1.51 | 3.71 |
| 2-17 | 1.28 | 0.81 | 1.51 | 3.60 |
| 2-18 | 1.28 | 0.73 | 1.51 | 3.52 |
| 2-19 | 1.43 | 0.98 | 1.85 | 4.26 |
| 2-20 | 1.43 | 0.98 | 1.66 | 4.07 |
| 2-21 | 1.43 | 0.98 | 1.51 | 3.92 |
| 2-22 | 1.28 | 0.81 | 1.66 | 3.76 |
| 2-23 | 1.28 | 0.81 | 1.38 | 3.48 |
| 2-24 | 1.28 | 0.81 | 1.66 | 3.76 |
| 2-25 | 1.28 | 0.81 | 1.38 | 3.48 |

The coatings were evaluated for DmaxL*, Fringing and Color in the same manner as in Example 1. Examples 2-1 through 2-9 demonstrate the effect of primarily changing the level of the Cyan Silver and the evaluation results are listed in Table 4d. Similarly, Examples 2-10 through 2-18 illustrate the effect of changing principally the magenta silver, (Table 4e). Examples 2-18 through 2-25 show the effect of varying mainly the yellow silver (Table 4f).

TABLE 4d

Effect of silver variations for Example 2-1 through 2-9.

| Example | Change Cyan Silver | Change Total Silver | Scavenger/ Silver Ratio | Scavenger/ Coupler Ratio | Dmax L* | Fringe Metric | Color Metric | Relative Fringe Metric |
|---|---|---|---|---|---|---|---|---|
| 2-1 Comparison | 0% | 0% | 0.17 | 0.61 | 7.1 | 34 | 72 | 100 |
| 2-2 Comparison | −16% | −6% | 0.18 | 0.61 | 7.1 | 26 | 73 | 76 |
| 2-3 Comparison | −28% | −11% | 0.19 | 0.61 | 7.8 | 25 | 73 | 71 |
| 2-4 Comparison | −12% | −12% | 0.19 | 0.68 | 9.8 | 87 | 72 | 252 |
| 2-5 Comparison | −25% | −17% | 0.20 | 0.68 | 10.2 | 66 | 72 | 191 |
| 2-6 Comparison | −34% | −21% | 0.21 | 0.68 | 10.8 | 61 | 72 | 178 |
| 2-7 Invention | −12% | −12% | 0.06 | 0.21 | 7.3 | 31 | 60 | 91 |
| 2-8 Invention | −25% | −17% | 0.06 | 0.21 | 7.8 | 13 | 60 | 38 |
| 2-9 Invention | −34% | −21% | 0.06 | 0.21 | 8.2 | 16 | 59 | 47 |

TABLE 4e

Effect of Silver variations for Example 2-10 through 2-18.

| Example | Change Magenta Silver | Change Total Silver | Scavenger/ Silver Ratio | Scavenger/ Coupler Ratio | Dmax L* | Fringe Metric | Color Metric | Relative Fringe Metric |
|---|---|---|---|---|---|---|---|---|
| 2-10 Comparison | 0% | 0% | 0.17 | 0.61 | 6.9 | 14 | 72 | 100 |
| 2-11 Comparison | −14% | −4% | 0.18 | 0.61 | 7.1 | 26 | 73 | 183 |
| 2-12 Comparison | −24% | −7% | 0.18 | 0.61 | 7.6 | 47 | 73 | 327 |
| 2-13 Comparison | −19% | −12% | 0.20 | 0.68 | 10.0 | 49 | 72 | 338 |
| 2-14 Comparison | −28% | −15% | 0.20 | 0.68 | 10.2 | 66 | 72 | 455 |
| 2-15 Comparison | −36% | −17% | 0.21 | 0.68 | 11.5 | 98 | 72 | 678 |
| 2-16 Invention | −19% | −12% | 0.06 | 0.21 | 7.5 | 15 | 60 | 104 |
| 2-17 Invention | −28% | −15% | 0.06 | 0.21 | 7.8 | 13 | 60 | 90 |
| 2-18 Invention | −36% | −17% | 0.06 | 0.21 | 7.6 | 20 | 59 | 138 |

TABLE 4f

Effect of Silver variations for Example 2-19 through 2-24.

| Example | Change Yellow Silver | Change Total Silver | Scavenger/ Silver Ratio | Scavenger/ Coupler Ratio | Dmax L* | Fringe Metric | Color Metric | Relative Fringe Metric |
|---|---|---|---|---|---|---|---|---|
| 2-19 Comparison | 0% | 0% | 0.17 | 0.61 | 7.00 | 27 | 73 | 100 |
| 2-20 Comparison | −10% | −4% | 0.18 | 0.61 | 7.10 | 26 | 73 | 99 |
| 2-21 Comparison | −18% | −8% | 0.18 | 0.61 | 7.60 | 46 | 72 | 172 |
| 2-22 Comparison | −10% | −12% | 0.19 | 0.68 | 10.4 | 74 | 72 | 277 |
| 2-23 Comparison | −25% | −18% | 0.21 | 0.68 | 10.6 | 63 | 72 | 238 |
| 2-24 Invention | −10% | −12% | 0.06 | 0.21 | 7.6 | 13 | 60 | 48 |
| 2-25 Invention | −25% | −18% | 0.06 | 0.21 | 8.2 | 28 | 59 | 105 |

The most dramatic effect is seen when the magenta silver is lowered, as illustrated in Table 4e. When the level is lowered, without decreasing the scavenger/coupler ratio and the scavenger/silver ratio, fringing becomes excessive. In these cases, the DmaxL* value also increases as the silver level is lowered and becomes very high for examples 2-13 through 2-15. On average, inventive examples 2-16 through 2-18 do not show the excessive fringing or high DmaxL* values relative to the comparisons.

Cyan silver can also be lowered significantly, as demonstrated in inventive examples 2-7 thorough 2-9 (Table 4d), without excessive fringing or high DmaxL*.

Finally, Table 4f, illustrates the effect of lowering yellow silver. Again, inventive examples 2-24 and 2-25 do not have the high fringing and high DmaxL* values of comparisons 2-22 and 2-23.

EXAMPLE 3

Comparison photographic coating 3-1 and identical inventive coatings 3-2 through 3-6 were prepared in the same manner as in Example 1, except for the component levels listed in Table 5a and 5b.

TABLE 5a

Component levels (mmol/m$^2$) for Example 3.

| Example | Total Scav-enger | Cyan Coupler | Magenta Coupler | Yellow Coupler | Total Coupler | Scavenger/ CouplerRatio |
|---|---|---|---|---|---|---|
| 3-1 | 0.64 | 0.33 | 0.24 | 0.63 | 1.19 | 0.54 |
| 3-2 through 3-6 | 0.44 | 0.29 | 0.24 | 0.63 | 1.15 | 0.38 |

TABLE 5b

Component levels (mmol/m$^2$) for Example 3.

| Example | Cyan Silver | Magenta Silver | Yellow Silver | Total Silver | Scavenger/ SilverRatio |
|---|---|---|---|---|---|
| 3-1 | 1.07 | 0.91 | 1.58 | 3.56 | 0.18 |
| 3-2 through 3-6 | 1.20 | 0.96 | 1.56 | 3.72 | 0.12 |

The photographic coatings were processed in a Noritsu QSS-3300 minilab modified to obtain shorter times in the processing solutions. The minilab was set-up and operated according to the information in Kodak Current Information Summary CIS-270, Using KODAK EKTACOLOR PRIME Chemicals with the NORITSU QSS System Minilab, with the exception of developer temperature and solution times. The developer temperature was set at 41° C. rather than 40° C. The solution times were changed through modifications to the processor. Three modifications were necessary. First, the drive gear on the machine was changed to allow an increase in transport speed. Second, the software was modified to allow selection of transport speed by changing the speed of the variable speed motor. Third, shorter racks were built for each of the tanks.

The length of the tanks was adjusted so as to achieve the processing times listed in Table 5d. The five variations tested and the resulting solution times are shown in the chart below.

TABLE 5c

Processing parameters for Example 3.

| Example | Type | Transport Rate (mm/min) | Developer Rack | Bleach/Fix Rack | Stabilizer Rack |
|---|---|---|---|---|---|
| 3-1 | Comparison | 1642 | Normal | Short | Short |
| 3-2 | Invention | 1642 | Normal | Short | Short |
| 3-3 | Invention | 2417 | Normal | Short | Short |
| 3-4 | Invention | 1953 | Short | Short | Short |
| 3-5 | Invention | 2417 | Short | Short | Short |
| 3-6 | Invention | 3416 | Short | Short | Short |

The example coatings were exposed and then processed for the developer, bleach/fix, and stabilizer times listed in Table 5d. The resulting images were evaluated for color reproduction as described previously. The color metric determined for each coating example is also listed in Table 5d.

TABLE 5d

Processing times and image evaluation for Example 3.

| Example | Type | Developer Time (sec) | Bleach/Fix Time (sec) | Stabilizer Time (sec) | Total Time (sec) | % Change* | Color Metric |
|---|---|---|---|---|---|---|---|
| 3-1 | Comparison | 45 | 25 | 48 | 118 | 0% | 67 |
| 3-2 | Invention | 45 | 25 | 48 | 118 | 0% | 65 |
| 3-3 | Invention | 30 | 17 | 32 | 79 | −22% | 66 |
| 3-4 | Invention | 21 | 21 | 40 | 82 | −31% | 67 |
| 3-5 | Invention | 17 | 17 | 32 | 66 | −44% | 67 |
| 3-6 | Invention | 12 | 12 | 24 | 48 | −59% | 68 |

*Percent change in total processing time relative to Example 3-1

As can be seen from Table 5d, the color metric for inventive Example 3-2 is lower, although still acceptable, relative to comparative Example 3-1 when both coatings are processed under standard conditions. Decreasing the processing time, and especially decreasing the development time, as illustrated in Examples 3-3 through 3-6, results in an increase in the resulting color metric to levels equal to Example 3-1. In this example, the total processing time can be decreased by as much as 60%.

The invention has been described in detail with particular reference to certain preferred embodiments thereof, but it will be understood that variations and modifications can be effected within the spirit and scope of the invention.

The invention claimed is:

1. A multilayer photographic element comprising a reflective support and at least three color records comprising at least three light sensitive layers and at least two interlayers, wherein:

a) said at least three light sensitive layers include at least one cyan, magenta, or yellow dye-forming coupler;

b) said at least three light sensitive layers include silver halide grains comprising greater than 90% silver chloride;

c) one or more scavengers are included in said at least two interlayers;

d) the ratio of the total level of scavenger to the total level of coupler in the multilayer photographic element is from 0.15 to 0.50;

e) the ratio of the total level of scavenger to the total level of silver in the multilayer photographic element is from 0.05 to 0.15; and f) the reciprocity characteristics of said silver halide grains of at least two color records of said at least three color records are such that for a separation exposure of 1 microsecond and 0.4 seconds, upon development, the difference in maximum density is 10% or less.

2. The multilayer photographic element of claim 1, wherein said ratio of the total level of scavenger to the total level of coupler in the multilayer photographic element is from 0.15 to 0.45.

3. The multilayer photographic element of claim 1, wherein said ratio of the total level of scavenger to the total level of coupler in the multilayer photographic element is from 0.20 to 0.40.

4. The multilayer photographic element of claim 1, wherein said ratio of the total level of scavenger to the total level of coupler in the multilayer photographic element is from 0.25 to 0.30.

5. The multilayer photographic element of claim 1, wherein said ratio of the total level of scavenger to the total level of silver in the multilayer photographic element is from 0.05 to 0.12.

6. The multilayer photographic element of claim 1, wherein said ratio of the total level of scavenger to the total level of silver in the multilayer photographic element is from 0.08 to 0.12.

7. The multilayer photographic element of claim 1, wherein said ratio of the total level of scavenger to the total level of coupler in the multilayer photographic element is from 0.25 to 0.30; and said ratio of the total level of scavenger to the total level of silver in the multilayer photographic element is from 0.08 to 0.12.

8. The multilayer photographic element of claim 1, wherein the total amount of scavenger present is from 0.20 to 0.50 mmol/$m^2$.

9. The multilayer photographic element of claim 1, wherein the total amount of scavenger present is from 0.30 to 0.40 mmol/$m^2$.

10. The multilayer photographic element of claim 1, wherein the total amount of silver present is from 3.0 to 4.0 mmol/$m^2$.

11. The multilayer photographic element of claim 1, wherein said cyan dye-forming coupler represented by the Formula CC-1:

CC-1

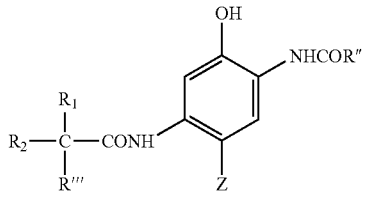

wherein:

R" and R'" are independently selected from unsubstituted or substituted alkyl, aryl, amino, alkoxy and heterocyclyl groups;

Z represents hydrogen, chloro, fluoro, substituted aryloxy or mercaptotetrazole group; and $R_1$ and $R_2$ independently represent hydrogen or an unsubstituted or substituted alkyl group.

12. The multilayer photographic element of claim 1, wherein said cyan dye-forming coupler includes a pyrrolotriazole.

13. The multilayer photographic element of claim 1, wherein said cyan dye-forming coupler is represented by the Formula CC-2:

CC-2

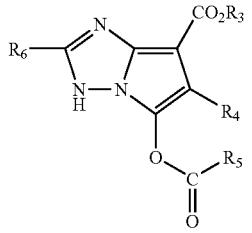

wherein:

$R_3$ represents an unsubstituted or substituted alkyl, aryl, amino, alkoxy or heterocyclyl group;

$R_4$ represents an electron-withdrawing group;

$R_5$ represents an unsubstituted or substituted alkyl, aryl, amino, alkoxy or heterocyclyl group; and $R_6$ represents an unsubstituted or substituted alkyl, aryl, or heterocyclyl group.

14. The multilayer photographic element of claim 1, wherein said magenta dye-forming coupler includes a pyrazoletriazole magenta dye-forming coupler.

15. The multilayer photographic element of claim 1, wherein said magenta dye-forming coupler comprises a pyrazoletriazole magenta dye-forming coupler of Formula MC-1,

MC-1

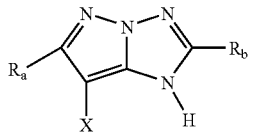

wherein:

$R_a$ and $R_b$ independently represent H or a substituent group; and

X is hydrogen or a chloro group.

16. The multilayer photographic element of claim 1, wherein said one or more scavangers comprises at least one hydroquinone.

17. The multilayer photographic element of claim 1, wherein said one or more scavangers comprises 2,5-bis(1,1,3,3-tetramethylbutyl)-1,4-benzenediol.

18. The multilayer photographic element of claim 1, wherein said reciprocity characteristics of the silver halide grains of said at least three color records are such that for a separation exposure of 1 microsecond and 0.4 seconds, upon development, the difference in maximum density is 5% or less.

19. A method of processing an exposed multilayer photographic element comprising color developing said exposed multilayer photographic element, wherein said color developing is for less than 30 seconds, and wherein said multilayer photographic element comprises a reflective support and at least three color records comprising at least three light sensitive layers and at least two interlayers, wherein:

a) said at least three light sensitive layers include at least one cyan, magenta, or yellow dye-forming coupler;

b) said at least three light sensitive layers include silver halide grains comprising greater than 90% silver chloride;

c) one or more scavengers are included in said at least two interlayers;

d) the ratio of the total level of scavenger to the total level of coupler in the multilayer photographic element is from 0.15 to 0.50;

e) the ratio of the total level of scavenger to the total level of silver in the multilayer photographic element is from 0.05 to 0.15; and f) the reciprocity characteristics of said silver halide grains of at least two color records of said at least three color records are such that for a separation exposure of 1 microsecond and 0.4 seconds, upon development, the difference in maximum density is 10% or less.

20. The method of claim 19, wherein said color developing is for less than 20 seconds.

21. The method of claim 19 further comprising bleach/fixing said exposed multilayer photographic element, and stabilizing said exposed multilayer photographic element.

* * * * *